US010731242B2

(12) United States Patent
Umehara et al.

(10) Patent No.: US 10,731,242 B2
(45) Date of Patent: Aug. 4, 2020

(54) NITRIDED STEEL PART AND METHOD OF PRODUCTION OF SAME

(71) Applicant: NIPPON STEEL & SUMITOMO METAL CORPORATION, Tokyo (JP)

(72) Inventors: Takahide Umehara, Tokyo (JP); Masato Yuya, Tokyo (JP); Yoshihiro Daito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 197 days.

(21) Appl. No.: 15/754,068

(22) PCT Filed: Sep. 8, 2016

(86) PCT No.: PCT/JP2016/076498

§ 371 (c)(1),
(2) Date: Feb. 21, 2018

(87) PCT Pub. No.: WO2017/043594

PCT Pub. Date: Mar. 16, 2017

(65) Prior Publication Data

US 2018/0245195 A1 Aug. 30, 2018

(30) Foreign Application Priority Data

Sep. 8, 2015 (JP) ..... 2015-176475

(51) Int. Cl.

| | |
|---|---|
| ***C23C 8/26*** | (2006.01) |
| ***C21D 9/32*** | (2006.01) |
| ***C22C 38/00*** | (2006.01) |
| ***C21D 9/00*** | (2006.01) |
| ***C22C 38/60*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/58*** | (2006.01) |

(52) U.S. Cl.

CPC ..... *C23C 8/26* (2013.01); *C21D 9/00* (2013.01); *C21D 9/32* (2013.01); *C22C 38/00* (2013.01); *C22C 38/001* (2013.01); *C22C 38/02* (2013.01); *C22C 38/06* (2013.01); *C22C 38/42* (2013.01); *C22C 38/44* (2013.01); *C22C 38/46* (2013.01); *C22C 38/50* (2013.01); *C22C 38/58* (2013.01); *C22C 38/60* (2013.01)

(58) Field of Classification Search

CPC ..... C23C 8/26; C22C 38/58; C22C 38/46; C22C 38/001; C22C 38/42; C22C 38/44; C22C 48/44

See application file for complete search history.

(56) References Cited

U.S. PATENT DOCUMENTS

| | | | |
|---|---|---|---|
| 6,093,263 | A | 7/2000 | Kobayashi et al. |
| 2013/0042992 | A1 | 2/2013 | Hiraoka et al. |
| 2013/0087250 | A1 | 4/2013 | Chida et al. |
| 2017/0016107 | A1 | 1/2017 | Umehara et al. |

FOREIGN PATENT DOCUMENTS

| | | | |
|---|---|---|---|
| JP | 10-226818 | A | 8/1998 |
| JP | 11-124653 | A | 5/1999 |
| JP | 11-269630 | A | 10/1999 |
| JP | 2006-22350 | A | 1/2006 |
| JP | 2006-28588 | A | 2/2006 |
| JP | 2007-31759 | A | 2/2007 |
| JP | 2012-36495 | A | 2/2012 |
| JP | 2013-44037 | A | 3/2013 |
| JP | 2013-221203 | A | 10/2013 |
| JP | 2015-52150 | A | 3/2015 |
| WO | WO 2015/034446 | A | 3/2015 |
| WO | WO 2015/136917 | A1 | 9/2015 |

OTHER PUBLICATIONS

ASM International, Materials Park, Ohio, Properties and Selection: Irons, Steels and High Performance Alloys, "High-Strength Structural and High-Strength Low-Alloy Steels", Mar. 1990, vol. 1, pp. 406-408.*

Extended European Search Report dated Dec. 21, 2018, for corresponding European Application No. 16844455.2.

International Search Report for PCT/JP2016/076498 dated Nov. 8, 2016.

Liedtke et al., Nitriding and Nitrocarburizing on Iron Materials, First Edition, First Print, AGNE Gijutsu Center Inc., Aug. 30, 2011, pp. 11-12, 37-39, 131-133 and 136-137, total 11 pages.

Written Opinion of the International Searching Authority for PCT/JP2016/076498 (PCT/ISA/237) dated Nov. 8, 2016.

Brazilian Office Action for corresponding Brazilian Application No. 112018003904-7, dated Feb. 27, 2020, with Partial English translation.

Chinese Office Action for corresponding Chinese Application No. 201680043181.3, dated Dec. 12, 2019, with English translation.

* cited by examiner

*Primary Examiner* — Jessee R Roe

(74) *Attorney, Agent, or Firm* — Birch, Stewart, Kolasch & Birch, LLP

(57) ABSTRACT

A nitrided steel part excellent in pitting resistance and bending fatigue characteristic enabling reduction of size and decrease of weight of parts or enabling demand for high load capacities to be met, using as a material a steel material containing, by mass %, C: 0.05 to 0.25%, Si: 0.05 to 1.5%, Mn: 0.2 to 2.5%, P: 0.025% or less, S: 0.003 to 0.05%, Cr: over 0.5 to 2.0%, Al: 0.01 to 0.05%, and N: 0.003 to 0.025%, having a balance of Fe and impurities, having formed on the steel surface a compound larger of a thickness 3 μm or less containing iron, nitrogen, and carbon and a hardened layer formed below the compound layer, and having an effective hardened layer depth of 160 to 410 μm.

4 Claims, 5 Drawing Sheets

NITRIDED STEEL PART AND METHOD OF PRODUCTION OF SAME

TECHNICAL FIELD

The present invention relates to a gas nitrided steel part, more particularly a gear, CVT sheave, or other nitrided steel part excellent in pitting resistance and bending fatigue characteristic, and a method of production of the same.

BACKGROUND ART

Steel parts used in automobiles and various industrial machinery etc. are improved in fatigue strength, wear resistance, seizing resistance, and other mechanical properties by carburizing hardening, high-frequency hardening, nitriding, soft nitriding, and other surface hardening heat treatment.

Nitriding and soft nitriding are performed in the ferrite region of the $A_1$ point or less. During treatment, there is no phase transformation, so it is possible to reduce the heat treatment strain. For this reason, nitriding and soft nitriding are often used for parts requiring high dimensional precision and large sized parts. For example, they are applied to the gears used for transmission parts in automobiles and the crankshafts used for engines.

Nitriding is a method of treatment diffusing nitrogen into the surface of a steel material. For the medium used for the nitriding, there are a gas, salt bath, plasma, etc. For the transmission parts of an automobile, gas nitriding is mainly being used since it is excellent in productivity. Due to gas nitriding, the surface of the steel material is formed with a compound layer of a thickness of 10 μm or more. Furthermore, the surface layer of a steel material at the lower side of the compound layer is formed with a nitrogen diffused layer forming a hardened layer. The compound layer is mainly comprised of $Fe_{2-3}N$ and $Fe_4N$. The hardness of the compound layer is extremely high compared with the steel of the base material. For this reason, the compound layer improves the wear resistance and pitting resistance of a steel part in the initial stage of use.

However, a compound layer is low in toughness and low in deformability, so sometimes the compound layer and the base layer peel apart at their interface during use and the strength of the part falls. For this reason, it is difficult to use a gas nitrided part as a part subjected to impact stress and large bending stress.

Therefore, for use as a part subjected to impact stress and large bending stress, reduction of the thickness of the compound layer and, furthermore, elimination of the compound layer are sought. In this regard, it is known that the thickness of the compound layer can be controlled by the treatment temperature of the nitriding and the nitriding potential $K_N$ found from the $NH_3$ partial pressure and $H_2$ partial pressure by the following formula:

$$K_N=(NH_3 \text{ partial pressure})/[(H_2 \text{ partial pressure})^{3/2}]$$

If lowering the nitriding potential $K_N$, it is also possible to make the compound layer thinner and even eliminate the compound layer. However, if lowering the nitriding potential $K_N$, it becomes hard for nitrogen to diffuse into the steel. In this case, the hardness of the hardened layer becomes lower and the depth becomes shallower. As a result, the nitrided part falls in fatigue strength, wear resistance, and seizing resistance. To deal with such a drop in performance, there is the method of mechanically polishing or shot blasting etc. the nitride part after gas nitriding to remove the compound layer. However, with this method, the production costs become higher.

PLT 1 proposes the method of dealing with such a problem by controlling the atmosphere of the gas nitriding by a nitriding parameter $K_N=(NH_3 \text{ partial pressure})/[(H_2 \text{ partial pressure})^{1/2}]$ different from the nitriding potential and reducing the variation in depth of the hardened layer.

PLT 2 proposes a gas nitriding method enabling formation of a hardened layer (nitrided layer) without forming a compound layer. The method of PLT 2 first removes the oxide film of a part by fluoride treatment then nitrides the part. A non-nitriding material is necessary as a fixture for placing the treated part in a treatment furnace.

However, the nitriding parameter proposed in PLT 1 may be useful for control of the depth of the hardened layer, but does not improve the functions of a part.

As proposed in PLT 2, in the case of the method of preparing a non-nitriding fixture and first performing fluoride treatment, the problems arise of the selection of the fixture and the increase in the number of work steps.

CITATION LIST

Patent Literature

PLT 1: Japanese Patent Publication No. 2006-28588A
PLT 2: Japanese Patent Publication No. 2007-31759A

SUMMARY OF INVENTION

Technical Problem

An object of the present invention is to provide a nitrided steel part excellent in pitting resistance and bending fatigue characteristic solving the two simultaneously difficult to solve problems of reduction of the thickness of a low toughness and low deformability compound layer and increase of the depth of the hardened layer and able to answer the demands for reduction of the size and decrease of the weight of a part or a higher load capacity and to provide a nitriding method of the same.

Solution to Problem

The inventors studied the method of making the compound layer formed on the surface of the steel material by nitriding thinner and obtaining a deep hardened layer. Furthermore, they simultaneously studied methods of keeping the nitrogen from forming a gas and creating voids near the surface of a steel material at the time of nitriding (in particular, at the time of treatment by a high $K_N$ value). In addition, they investigated the relationship between the nitriding conditions and the pitting resistance and bending fatigue characteristic. As a result, the inventors obtained the following findings (a) to (d):

(a) Regarding $K_N$ Value in Gas Nitriding

In general, the $K_N$ value is defined by the following formula using the $NH_3$ partial pressure and the $H_2$ partial pressure in the atmosphere in the furnace performing the gas nitriding (below, referred to as the "nitriding atmosphere" or simply the "atmosphere").

$$K_N=(NH_3 \text{ partial pressure})/[(H_2 \text{ partial pressure})^{3/2}]$$

The $K_N$ value can be controlled by the gas flow rates. However, a certain time is required after setting the gas flow rates until the nitriding atmosphere reaches the equilibrium state. For this reason, the $K_N$ value changes with each instant even before the $K_N$ value reaches the equilibrium state. Further, even if changing the $K_N$ value in the middle of the gas nitriding, the $K_N$ value fluctuates until reaching the equilibrium state.

The above such fluctuation of the $K_N$ value has an effect on the compound layer, surface hardness, and depth of the hardened layer. For this reason, not only the target value of the $K_N$ value, but also the range of variation of the $K_N$ value during gas nitriding have to be controlled to within a predetermined range.

(b) Regarding Realization of Both Suppression of Formation of Compound Layer and Securing Surface Hardness and Depth of Hardened Layer In the various experiments conducted by the inventors, the thickness of the compound layer, voids in the compound layer, surface hardness, and depth of the hardened layer were related to the pitting resistance and bending fatigue characteristic of the nitrided part. If the compound layer is thick and, further, there are many voids in the compound layer, cracks easily form starting from the compound layer and the pitting strength and bending fatigue strength fall.

Further, the lower the surface hardness and the shallower the depth of the hardened layer, the more cracks and fractures occur starting from the diffused layer and the more the pitting strength and bending fatigue strength fall. That is, the inventors discovered that the thinner the compound layer is thin, there are few voids in the compound layer, the surface hardness is high, and the deeper the depth of the hardened layer, the better the pitting resistance.

From the above, to achieve both pitting resistance and bending fatigue characteristic, it is important to prevent the formation of a compound layer as much as possible and to increase the surface hardness and depth of the hardened layer.

To suppress the formation of the compound layer and secure the depth of the hardened layer, it is efficient to form a compound layer once, then break down the formed compound layer and utilize it as a source of supply of nitrogen to the hardened layer. Specifically, in the first half of the gas nitriding, gas nitriding raising the nitriding potential (high $K_N$ value treatment) is performed to form the compound layer. Further, in the second half of the gas nitriding, gas nitriding lowered in nitriding potential than the high $K_N$ value treatment (low $K_N$ value treatment) is performed. As a result, the compound layer formed in the high $K_N$ value treatment is broken down into Fe and N. The N diffuses, thereby promoting the formation of a nitrogen diffused layer (hardened layer). Finally, at the nitrided part, it is possible to make the compound layer thinner, raise the surface hardness, and increase the depth of the hardened layer.

(c) Regarding Suppression of Formation of Voids

When nitriding by the high $K_N$ value in the first half of the gas nitriding, sometimes a layer including voids (porous layer) is formed in the compound layer (FIG. 1A). In this case, even after the nitrides break down and the nitrogen diffused layer (hardened layer) is formed, voids remain as they are inside the nitrogen diffused layer. If voids remain inside the nitrogen diffused layer, the nitrided part falls in fatigue strength. If restricting the upper limit of the $K_N$ value when forming the compound layer in the high $K_N$ value treatment, it is possible to suppress the formation of the porous layer and voids (FIG. 1B).

(d) Regarding Relationship of Components of Steel Material and Compound Layer and Nitrogen Diffused Layer If C is present in the steel material, the bending resistance of the compound layer deteriorates. Further, if Mn, Cr, and other nitride compound forming elements are present, the hardness of the nitrogen diffused layer and the depth of the diffused layer changes. The pitting resistance and bending fatigue characteristic are improved the higher the diffused layer hardness and, further, the deeper the diffused layer, so it becomes necessary to set the optimal range of the steel material components.

The present invention was made based on the above discoveries and has as its gist the following:

[1] A nitrided steel part comprising a steel material as a material, the steel material consisting of, by mass %, C: 0.05 to 0.25%, Si: 0.05 to 1.5%, Mn: 0.2 to 2.5%, P: 0.025% or less, S: 0.003 to 0.05%, Cr: over 0.5 to 2.0%, Al: 0.01 to 0.05%, N: 0.003 to 0.025% and a balance of Fe and impurities, the nitrided steel part comprising a compound layer of a thickness of 3 μm or less containing iron, nitrogen, and carbon formed on the steel surface and a hardened layer formed under the compound layer, an effective hardened layer depth of the nitrided steel part being 160 to 410 μm.

[2] The nitrided steel part of [1] wherein the steel material contains, in place of part of Fe, one or both of Mo: 0.01 to less than 0.50% and V: 0.01 to less than 0.50%.

[3] The nitrided steel part of [1] or [2] wherein the steel material contains, in place of part of Fe, one or both of Cu: 0.01 to less than 0.50% and Ni: 0.01 to less than 0.50%.

[4] The nitrided part of any one of [1] to [3] wherein the steel material contains, in place of part of Fe, Ti: 0.005 to less than 0.05%.

[5] A method of production of a nitrided steel part comprising a steel material as a material, the steel material consisting of, by mass %, C: 0.05 to 0.25%, Si: 0.05 to 1.5%, Mn: 0.2 to 2.5%, P: 0.025% or less, S: 0.003 to 0.05%, Cr: over 0.5 to 2.0%, Al: 0.01 to 0.05%, N: 0.003 to 0.025% and a balance of Fe and impurities, the method comprising providing a step of gas nitriding by heating the steel material in a gas atmosphere containing $NH_3$, $H_2$, and $N_2$ to 550 to 620° C., and making the overall treatment time A 1.5 to 10 hours, the gas nitriding comprising high $K_N$ value treatment having a treatment time of X hours and a low $K_N$ value treatment after the high $K_N$ value treatment having a treatment time of Y hours, the high $K_N$ value treatment having a nitriding potential $K_{NX}$ determined by formula (1) of 0.15 to 1.50 and having an average value $K_{NXave}$ of the nitriding potential $K_{NX}$ determined by formula (2) of 0.30 to 0.80, the low $K_N$ value treatment having a nitriding potential $K_{NY}$ determined by formula (3) of 0.02 to 0.25, having an average value $K_{NYave}$ of the nitriding potential $K_{NY}$ determined by formula (4) of 0.03 to 0.20, and having an average value $K_{Nave}$ of the nitriding potential determined by formula (5) of 0.07 to 0.30:

$$K_{NX}=(\text{NH}_3\text{ partial pressure})_X/[(\text{H}_2\text{ partial pressure})^{3/2}]_X \quad (1)$$

$$K_{NXave}=\Sigma_{i=1}^{n}(X_0\times K_{NXi})/X \quad (2)$$

$$K_{NY}=(\text{NH}_3\text{ partial pressure})_Y/[(\text{H}_2\text{ partial pressure})^{3/2}]_Y \quad (3)$$

$$K_{NYave}=\Sigma_{i=1}^{n}(Y_0\times K_{NYi})/Y \quad (4)$$

$$K_{Nave}=(X\times K_{NXave}+Y\times K_{NYave})/A \quad (5)$$

wherein, in formula (2) and formula (4), the subscript "i" is a number indicating the number of measurements for each constant time interval, $X_0$ indicates the measurement interval (hours) of the nitriding potential $K_{NX}$, $Y_0$ indicates the measurement interval (hours) of the nitriding potential $K_{NY}$, $K_{NXi}$ indicates the nitriding potential at the i-th measurement during the high $K_N$ value treatment, and $K_{NYi}$ indicates the nitriding potential at the i-th measurement during the low $K_N$ value treatment.

[6] The method of production of the nitrided steel part of [5] wherein the gas atmosphere includes a total of 99.5 vol % of $NH_3$, $H_2$, and $N_2$.

[7] The method of production of the nitrided steel part of [5] or [6] wherein the steel material contains, in place of part of the Fe, one or both of Mo: 0.01 to less than 0.50% and V: 0.01 to less than 0.50%.

[8] The method of production of the nitrided steel part of any one of [5] to [7] wherein the steel material contains, in place of part of the Fe, one or both of Cu: 0.01 to less than 0.50% and Ni: 0.01 to less than 0.50%.

[9] The method of production of the nitrided steel part of any one of [5] to [8] wherein the steel material contains, in place of part of the Fe, Ti: 0.005 to less than 0.05%.

Advantageous Effects of Invention

According to the present invention, it is possible to obtain a nitrided steel part having a thin compound layer, suppressed formation of voids (porous layer), furthermore, high surface hardness and a deep hardened layer, and an excellent pitting resistance and bending fatigue characteristic.

BRIEF DESCRIPTION OF DRAWINGS

FIG. 1 Views showing a compound layer after nitriding, wherein FIG. 1A shows an example of formation of a porous layer containing voids in the compound layer and FIG. 1B shows an example where formation of a porous layer and voids is suppressed.

DESCRIPTION OF EMBODIMENTS

Figure 1:
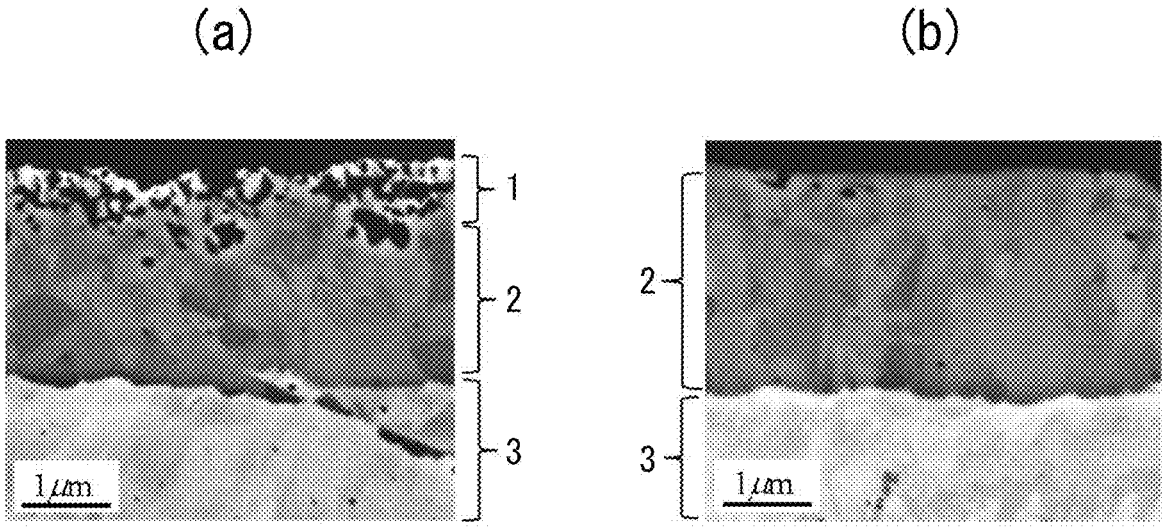

Below, the requirements of the present invention will be explained in detail. First, the chemical composition of the steel material used as a material will be explained. Below, the "%" showing the contents of the component elements and concentrations of elements at the part surface should be deemed to mean "mass %".

C: 0.05 to 0.25%

C is an element required for securing the core hardness of a part. If the content of C is less than 0.05%, the core strength becomes too low, so the pitting strength and bending fatigue strength greatly fall. Further, if the content of C exceeds 0.25%, during high $K_N$ value treatment, the compound layer thickness easily becomes larger. Further, during low $K_N$ value treatment, the compound layer becomes resistant to breakdown. For this reason, it becomes difficult to reduce the compound layer thickness after nitriding and the pitting strength and bending fatigue strength sometimes fall. Further, the strength after hot forging becomes too high, so machinability greatly falls. The preferable range of the C content is 0.08 to 0.20%.

Si: 0.05 to 1.5%

Si raises the core hardness by solution strengthening. Further, it is a deoxidizing element. To obtain these effects, 0.05% or more is included. On the other hand, if the content of Si exceeds 1.5%, in bars and wire rods, the strength after hot forging becomes too high, so the machinability greatly falls. The preferable range of the Si content is 0.08 to 1.3%.

Mn: 0.2 to 2.5%

Mn raises the core hardness by solution strengthening. Furthermore, Mn forms fine nitrides ($Mn_3N_2$) in the hardened layer at the time of nitriding and improves the pitting strength and bending fatigue strength by precipitation strengthening. To obtain these effects, Mn has to be 0.2% or more. On the other hand, if the content of Mn exceeds 2.5%, the precipitation strengthening ability becomes saturated. Furthermore, the effective hardened layer depth becomes shallower, so the pitting strength and the bending fatigue strength fall. Further, the bars and wire rods used as materials become too high in hardness after hot forging, so the machinability greatly falls. The preferable range of the Mn content is 0.4 to 2.3%.

P: 0.025% or Less

P is an impurity and precipitates at the grain boundaries to make a part brittle, so the content is preferably small. If the content of P is over 0.025%, sometimes the bending straightening ability and bending fatigue strength fall. The preferable upper limit of the content of P for preventing a drop in the bending fatigue strength is 0.018%. It is difficult to make the content completely zero. The practical lower limit is 0.001%.

S: 0.003 to 0.05%

S bonds with Mn to form MnS and raise the machinability. To obtain this effect, S has to be 0.003% or more. However, if the content of S exceeds 0.05%, coarse MnS easily forms and the pitting strength and bending fatigue strength greatly fall. The preferable range of the S content is 0.005 to 0.03%.

Cr: over 0.5 to 2.0%

Cr forms fine nitrides ($Cr_2N$) in the hardened layer during nitriding and improves the pitting strength and bending fatigue strength by precipitation strengthening. To obtain the effects, Cr has to be over 0.5%. On the other hand, if the content of Cr is over 2.0%, the precipitation strengthening ability becomes saturated. Furthermore, the effective hardened layer depth becomes shallower, so the pitting strength and bending fatigue strength fall. Further, the bars and wire rods used as materials become too high in hardness after hot forging, so the machinability remarkably falls. The preferable range of the Cr content is 0.6 to 1.8%.

Al: 0.01 to 0.05%

Al is a deoxidizing element. For sufficient deoxidation, 0.01% or more is necessary. On the other hand, Al easily forms hard oxide inclusions. If the content of Al exceeds 0.05%, the bending fatigue strength remarkably falls. Even if other requirements are met, the desired bending fatigue strength can no longer be obtained. The preferable range of the Al content is 0.02 to 0.04%.

N: 0.003 to 0.025%

N bonds with Al, V, and Ti to form AlN, VN, and TiN. Due to their actions of pinning austenite grains, AlN, VN, and TiN have the effect of refining the structure of the steel material before nitriding and reducing the variation in mechanical characteristics of the nitrided steel part. If the content of N is less than 0.003%, this effect is difficult to obtain. On the other hand, if the content of N exceeds 0.025%, coarse AlN easily forms, so the above effect becomes difficult to obtain. The preferable range of the content of N is 0.005 to 0.020%.

The steel used as the material for the nitrided steel part of the present invention may also contain the elements shown below in addition to the above elements.

Mo: 0.01 to Less than 0.50%

Mo forms fine nitrides ($Mo_2N$) in the hardened layer during nitriding and improves the pitting strength and bending fatigue strength by precipitation strengthening. Further, Mo has the action of age hardening and improves the core hardness at the time of nitriding. The content of Mo for obtaining these effects has to be 0.01% or more. On the other hand, if the content of Mo is 0.50% or more, the bars and wire rods used as materials become too high in hardness after hot forging, so the machinability remarkably falls. In addition, the alloy costs increase. The preferable upper limit of the Mo content for securing machinability is less than 0.40%.

V: 0.01 to Less than 0.50%

V forms fine nitrides (VN) at the time of nitriding and soft nitriding and improves the pitting strength and bending fatigue strength by precipitation strengthening. Further, V has the action of age hardening to improve the core hardness at the time of nitriding. Furthermore, due to the action of pinning austenite grains, it also has the effect of refining the structure of the steel material before nitriding. To obtain these actions, V has to be 0.01% or more. On the other hand, if the content of V is 0.50% or more, the bars and wire rods used for materials become too high in hardness after hot forging, so the machinability remarkably falls. In addition, the alloy costs increase. The preferable range of content of V for securing machinability is less than 0.40%.

Cu: 0.01 to 0.50%

Cu improves the core hardness of the part and the hardness of the nitrogen diffused layer as a solution strengthening element. To obtain the action of solution strengthening of Cu, inclusion of 0.01% or more is necessary. On the other hand, if the content of Cu exceeds 0.50%, the bars and wire rods used as materials become too high in hardness after hot forging, so the machinability remarkably falls. In addition, the hot ductility falls. Therefore, this becomes a cause of surface scratches at the time of hot rolling and at the time of hot forging. The preferable range of the content of Cu for maintaining hot ductility is less than 0.40%.

Ni: 0.01 to 0.50%

Ni improves the core hardness and surface layer hardness by solution strengthening. To obtain the action of solution strengthening of Ni, inclusion of 0.01% or more is necessary. On the other hand, if the content of Ni exceeds 0.50%, the bars and wire rods used as materials become too high in hardness after hot forging, so the machinability remarkably falls. In addition, the alloy costs increase. The preferable range of the Ni content for obtaining sufficient machinability is less than 0.40%.

Ti: 0.005 to 0.05%

Ti bonds with N to form TiN and improve the core hardness and surface layer hardness. To obtain this action, Ti has to be 0.005% or more. On the other hand, if the content of Ti is 0.05% or more, the effect of improving the core hardness and surface layer hardness becomes saturated. In addition, the alloy costs increase. The preferable range of content of Ti is 0.007 to less than 0.04%.

The balance of the steel is Fe and impurities. "Impurities" mean components which are contained in the starting materials or mixed in during the process of production and not components which are intentionally included in the steel. The above optional added elements of Mo, V, Cu, Ni, and Ti are sometimes included in amounts of less than the above lower limits, but in this case, just the effects of the elements explained above are not sufficiently obtained. The effect of improvement of the pitting resistance and bending fatigue characteristic of the present invention is obtained, so this is not a problem.

Below, one example of the method of production of the nitrided steel part of the present invention will be explained. The method of production explained below is just one example. The nitrided steel part of the present invention need only have a thickness of the compound layer of 3 μm or less and an effective hardened layer depth of 160 to 410 μm. It is not limited to the following method of production.

In the method of production of the nitrided steel part of the present invention, steel having the above-mentioned components is gas nitrided. The treatment temperature of the gas nitriding is 550 to 620° C., while the treatment time A of the gas nitriding as a whole is 1.5 to 10 hours.

Treatment Temperature: 550 to 620° C.

The temperature of the gas nitriding (nitriding temperature) is mainly correlated with the rate of diffusion of nitrogen and affects the surface hardness and depth of the hardened layer. If the nitriding temperature is too low, the rate of diffusion of nitrogen is slow, the surface hardness becomes low, and the depth of the hardened layer becomes shallower. On the other hand, if the nitriding temperature is over the $A_{C1}$ point, austenite phases (γ phases) with a smaller rate of diffusion of nitrogen than ferrite phases (α phases) are formed in the steel, the surface hardness becomes lower, and the depth of the hardened layer becomes shallower. Therefore, in the present embodiment, the nitriding temperature is 550 to 620° C. around the ferrite temperature region. In this case, the surface hardness can be kept from becoming lower and the depth of the hardened layer can be kept from becoming shallower.

Treatment Time A of Gas Nitriding as a Whole: 1.5 to 10 Hours

The gas nitriding is performed in an atmosphere including $NH_3$, $H_2$, and $N_2$. The time of the nitriding as a whole, that is, the time from the start to end of the nitriding (treatment time A), is correlated with the formation and breakdown of the compound layer and the diffusion of nitrogen and affects the surface hardness and depth of the hardened layer. If the treatment time A is too short, the surface hardness becomes lower and the depth of the hardened layer becomes shallower. On the other hand, if the treatment time A is too long, the nitrogen is removed and the surface hardness of the steel falls. If the treatment time A is too long, further, the manufacturing costs rise. Therefore, the treatment time A of the nitriding as a whole is 1.5 to 10 hours.

Note that, the atmosphere of the gas nitriding of the present embodiment includes not only $NH_3$, $H_2$, and $N_2$ but also unavoidable impurities such as oxygen and carbon dioxide. The preferable atmosphere is $NH_3$, $H_2$, and $N_2$ in a total of 99.5% (vol %) or more. The later explained $K_N$ value is calculated from the ratio of the $NH_3$ and $H_2$ partial pressures in the atmosphere, so is not affected by the magnitude of the $N_2$ partial pressure. However, to raise the stability of $K_N$ control, the $N_2$ partial pressure is preferably 0.2 to 0.5 atm.

High $K_N$ Value Treatment and Low $K_N$ Value Treatment

The above-mentioned gas nitriding includes a step of performing high $K_N$ value treatment and a step of performing low $K_N$ value treatment. In high $K_N$ value treatment, gas nitriding is performed by a nitriding potential $K_{NX}$ higher than the low $K_N$ value treatment. Furthermore, after high $K_N$ value treatment, low $K_N$ value treatment is performed. In the low $K_N$ value treatment, gas nitriding is performed by a nitriding potential $K_{NY}$ lower than the high $K_N$ value treatment.

In this way, in the present nitriding method, two-stage gas nitriding (high $K_N$ value treatment and low $K_N$ value treatment) is performed. By raising the nitriding potential $K_N$ value in the first half of the gas nitriding (high $K_N$ value treatment), a compound layer is formed at the surface of the steel. After that, by lowering the nitriding potential $K_N$ value in the second half of the gas nitriding (low $K_N$ value treatment), the compound layer formed at the surface of the steel is broken down into Fe and N and the nitrogen (N) is made to penetrate and diffuse in the steel. By the two-stage gas nitriding, the thickness of the compound layer formed by the high $K_N$ value treatment is reduced while the nitrogen obtained by breakdown of the compound layer is used to obtain a sufficient depth of the hardened layer.

The nitriding potential of the high $K_N$ value treatment is denoted as $K_{NX}$, while the nitriding potential of the low $K_N$ value treatment is denoted as $K_{NY}$. At this time, the nitriding potentials $K_{NX}$ and $K_{NY}$ are defined by the following formula:

$$K_{NX}=(\mathrm{NH_3\ partial\ pressure})_X/[(\mathrm{H_2\ partial\ pressure})^{3/2}]_X$$

$$K_{NY}=(\mathrm{NH_3\ partial\ pressure})_Y/[(\mathrm{H_2\ partial\ pressure})^{3/2}]_Y$$

The partial pressures of the $NH_3$ and $H_2$ in the atmosphere of the gas nitriding can be controlled by adjusting the flow rates of the gases.

When shifting from the high $K_N$ value treatment to the low $K_N$ value treatment, if adjusting the flow rates of the gases to lower the $K_N$ value, a certain extent of time is required until the partial pressures of $NH_3$ and $H_2$ in the furnace stabilize. The gas flow rates can be adjusted for changing the $K_N$ value one time or if necessary several times. To increase the amount of drop of the $K_N$ value more, the method of lowering the $NH_3$ flow rate and raising the $H_2$ flow rate is effective. The point of time when the $K_N$ value after high $K_N$ value treatment finally becomes 0.25 or less is defined as the start timing of the low $K_N$ value treatment.

The treatment time of the high $K_N$ value treatment is denoted as "X" (hours), while the treatment time of the low $K_N$ value treatment is denoted as "Y" (hours). The total of the treatment time X and the treatment time Y is within the treatment time A of the nitriding overall, preferably is the treatment time A.

Various Conditions at High $K_N$ Value Treatment and Low $K_N$ Value Treatment

As explained above, the nitriding potential during the high $K_N$ value treatment is denoted as $K_{NX}$, while the nitriding potential during the low $K_N$ value treatment is denoted by $K_{NY}$. Furthermore, the average value of the nitriding potential during high $K_N$ value treatment is denoted by "$K_{NXave}$", while the average value of the nitriding potential during low $K_N$ value treatment is denoted by "$K_{NYave}$". $K_{NXave}$ and $K_{NYave}$ are defined by the following formulas:

$$K_{NXave}=\Sigma_{i=1}^{n}(X_0\times K_{NXi})/X$$

$$K_{NYave}=\Sigma_{i=1}^{n}(Y_0\times K_{NYi})/Y$$

Here, the subscript "i" is a number expressing the number of times of measurement every certain time interval. $X_0$ indicates the measurement interval of the nitriding potential $K_{NX}$ (hours), $Y_0$ indicates the measurement interval of the nitriding potential $K_{NY}$ (hours), $K_{NXi}$ indicates the nitriding potential at the i-th measurement during the high $K_N$ value treatment, and $K_{NYi}$ indicates the nitriding potential at the i-th measurement during the low $K_N$ value treatment.

For example, $X_0$ is made 15 minutes. 15 minutes after the start of treatment, measurement is conducted the first time (i=1). Each 15 minutes after that, measurement is conducted the second time (i=2) and the third time (i=3). $K_{NXave}$ is calculated by measurement of the "n" number of times measurable up to the treatment time. $K_{NYave}$ is calculated in the same way.

Furthermore, the average value of the nitriding potential of the nitriding as a whole is denoted as "$K_{Nave}$". The average value $K_{Nave}$ is defined by the following formula:

$$K_{Nave}=(X\times K_{NXave}+Y\times K_{NYave})/A$$

In the nitriding method of the present invention, the nitriding potential $K_{NX}$, average value $K_{NXave}$, and treatment time X of the high $K_N$ value treatment and the nitriding potential $K_{NX}$, average value $K_{NYave}$, treatment time Y, and average value $K_{Nave}$ of the low $K_N$ value treatment satisfy the following conditions (I) to (IV):

(I) Average value $K_{NXave}$: 0.30 to 0.80

(II) Average value $K_{NYave}$: 0.03 to 0.20

(III) $K_{NX}$: 0.15 to 1.50, and $K_{NY}$: 0.02 to 0.25

(IV) Average value $K_{Nave}$: 0.07 to 0.30

Below, the Conditions (I) to (IV) will be explained.

(I) Average Value $K_{NXave}$ of Nitriding Potential in High $K_N$ Treatment

In the high $K_N$ value treatment, the average value $K_{NXave}$ of the nitriding potential has to be 0.30 to 0.80 to form a compound layer of a sufficient thickness.

Figure 2:
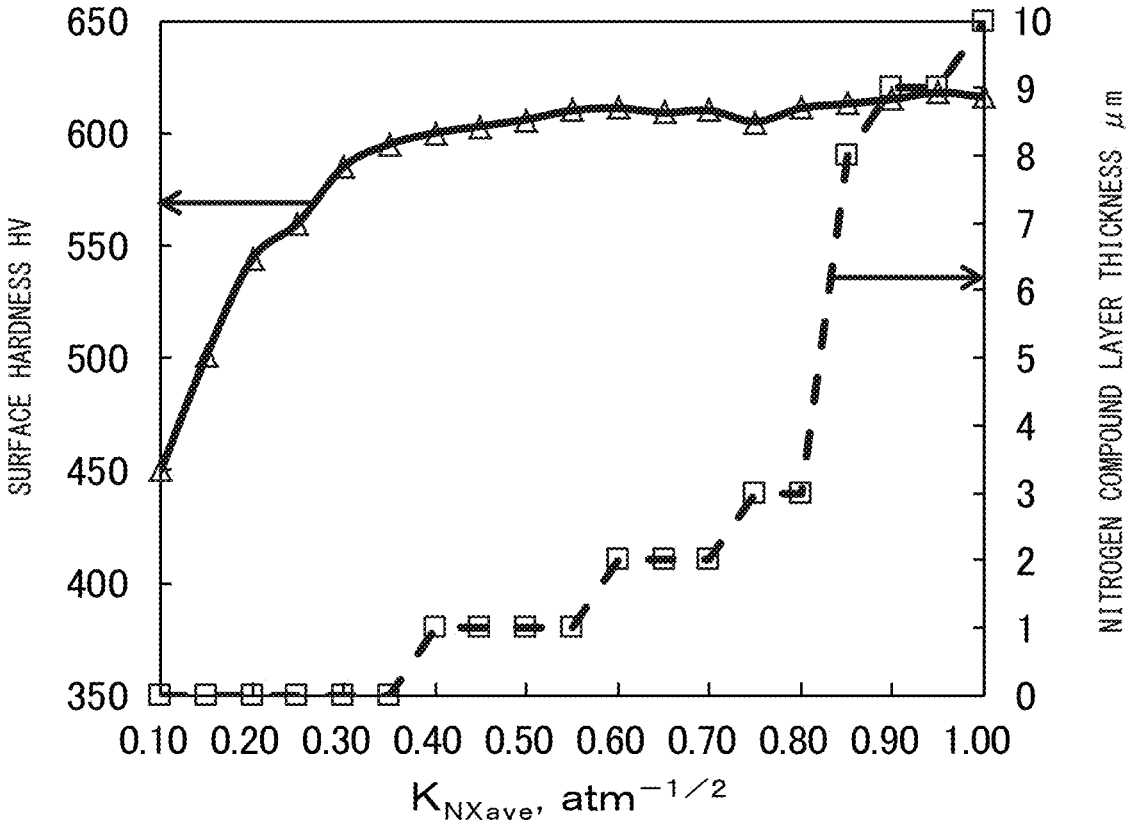
FIG. 2 A view showing a relationship of an average value $K_{NXave}$ of a nitriding potential of a high $K_N$ value treatment and a surface hardness and compound layer thickness.

FIG. 2 is a view showing the relationship of the average value $K_{NXave}$ and the surface hardness and compound layer thickness. FIG. 2 is obtained from the following experiments.

The steel "a" having the chemical composition prescribed in the present invention (see Table 1, below referred to as the "test material") was gas nitrided in a gas atmosphere containing $NH_3$, $H_2$, and $N_2$. In the gas nitriding, the test material was inserted into a heat treatment furnace heated to a predetermined temperature and able to be controlled in atmosphere then $NH_3$, $N_2$, and $H_2$ gases were introduced. At this time, the partial pressures of the $NH_3$ and $H_2$ in the atmosphere of the gas nitriding were measured while adjusting the flow rates of the gases to control the nitriding potential $K_N$ value. The $K_N$ value was found in accordance with the above formula by the $NH_3$ partial pressure and $H_2$ partial pressure.

The $H_2$ partial pressure during gas nitriding was measured by using a heat conduction type $H_2$ sensor directly attached to the gas nitriding furnace body and converting the difference in heat conductivity between standard gas and measured gas to the gas concentration. The $H_2$ partial pressure was measured continuously during the gas nitriding. The $NH_3$ partial pressure during the gas nitriding was measured by attachment of a manual glass tube type $NH_3$ analysis meter outside of the furnace. The partial pressure of the residual $NH_3$ was calculated and found every 15 minutes. Every 15 minutes of measurement of the $NH_3$ partial pressure, the nitriding potential $K_N$ value was calculated. The $NH_3$ flow rate and $N_2$ flow rate were adjusted to converge to the target values.

The gas nitriding was performed with a temperature of the atmosphere of 590° C., a treatment time X of 1.0 hour, a treatment time Y of 2.0 hours, a $K_{NYave}$ of a constant 0.05, and a $K_{NXave}$ changed from 0.10 to 1.00. The overall treatment time A was made 3.0 hours.

Test materials gas nitrided by various average values $K_{NXave}$ were measured and tested as follows.

Measurement of Thickness of Compound Layer

After gas nitriding, the cross-section of the test material was polished, etched, and examined under an optical microscope. The etching was performed by a 3% Nital solution for 20 to 30 seconds. A compound layer was present at the surface layer of the steel and was observed as a white uncorroded layer. From five fields of the photographed structure taken by an optical microscope at 500× (field area: $2.2\times10^4$ μm$^2$), the thicknesses of the compound layer at four points were respectively measured every 30 μm. The average value of the values of the 20 points measured was defined as the compound thickness (μm). When the compound layer thickness was 3 pin or less, peeling and cracking were largely suppressed. Accordingly, in the present invention, the compound layer thickness has to be made 3 μm or less. The compound layer thickness may also be 0.

Phase Structure of Compound Layer

The phase structure of the compound layer is preferably one where, by area ratio, γ' ($Fe_4N$) becomes 50% or more. The balance is ε ($Fe_{2-3}N$). With general soft nitriding, the compound layer becomes mainly ε ($Fe_{2-3}N$), but with the nitriding of the present invention, the ratio of γ' ($Fe_4N$) becomes larger. The phase structure of the compound layer can be investigated by the SEM-EBSD method.

Measurement of Void Area Ratio

Furthermore, the area ratio of the voids in the surface layer structure at a cross-section of the test material was measured by observation under an optical microscope. The ratio of voids in an area of 25 μm$^2$ in a range of 5 μm depth from the outermost surface (below, referred to as the "void area ratio") was calculated for each field in measurement of five fields at a power of 1000× (field area: $5.6\times10^3$ μm$^2$). If the void area ratio is 10% or more, the surface roughness of the nitrided part after gas nitriding becomes coarser. Furthermore, the compound layer becomes brittle, so the nitrided part falls in fatigue strength. Therefore, in the present invention, the void area ratio has to be less than 10%. The void area ratio is preferably less than 8%, more preferably less than 6%.

Measurement of Surface Hardness

Furthermore, the surface hardness and effective hardened layer depth of the test material after gas nitriding were found by the following method. The Vickers hardness in the depth direction from the sample surface was measured based on JIS Z 2244 by a test force of 1.96N. Further, the average value of three points of the Vickers hardness at a position of 50 μm depth from the surface was defined as the surface hardness (HV). In the present invention, 570 HV or more is targeted as a surface hardness equal to the case of general gas nitriding where over 3 μm of a compound layer remains.

Measurement of Effective Hardened Layer Depth

In the present invention, the effective hardened layer depth (μm) is defined as the depth in a range where the Vickers hardness in the distribution measured in the depth direction from the surface of the test material using the hardness distribution in the depth direction obtained by the above Vickers hardness test is 300 HV or more.

At the treatment temperature of 570 to 590° C., in the case of general gas nitriding where a compound layer of 10 μm or more is formed, if the treatment time of the gas nitriding as a whole is A (hours), the effective hardened layer depth becomes the value found by the following formula (A)±20 μm.

$$\text{Effective hardened layer depth } (\mu m) = 130\times\{\text{treatment time } A \text{ (hours)}\}^{1/2} \quad (A)$$

In the nitrided steel part of the present invention, the effective hardened layer depth was made 130×{treatment time A (hours)}$^{1/2}$. In the present embodiment, the treatment time A of the gas nitriding as a whole, as explained above, was 1.5 to 10 hours, so the effective hardened layer depth was targeted as 160 to 410 μm.

As a result of the above-mentioned measurement test, if the average value $K_{NYave}$ is 0.20 or more, the effective hardened layer depth was 160 to 410 μm (when A=3, effective hardened layer depth 225 μm). Furthermore, in the results of the measurement tests, the surface hardnesses and thicknesses of the compound layers of the test materials obtained by gas nitriding at the different average values $K_{NXave}$ were used to prepare FIG. 2.

The solid line in FIG. 2 is a graph showing the relationship of the average value $K_{NXave}$ and surface hardness (HV). The broken line in FIG. 2 is a graph showing the relationship of the average value $K_{NXave}$ and the thickness of the compound layer (μm).

Referring to the solid line graph of FIG. 2, if the average value $K_{NYave}$ at the low $K_N$ value treatment is constant, as the average value $K_{NXave}$ at the high $K_N$ value treatment becomes higher, the surface hardness of the nitrided part remarkably increases. Further, when the average value $K_{NXave}$ becomes 0.30 or more, the surface hardness becomes the targeted 570 HV or more. On the other hand, if the average value $K_{NXave}$ is higher than 0.30, even if the average value $K_{NXave}$ becomes further higher, the surface hardness remains substantially constant. That is, in the graph of the average value $K_{NXave}$ and surface hardness (solid line in FIG. 2), there is an inflection point near $K_{NXave}$=0.30.

Furthermore, referring to the broken line graph of FIG. 2, as the average value $K_{NXave}$ falls from 1.00, the compound thickness remarkably decreases. Further, when the average value $K_{NXave}$ becomes 0.80, the thickness of the compound layer becomes 3 μm or less. On the other hand, with an average value $K_{NXave}$ of 0.80 or less, as the average value $K_{NXave}$ falls, the thickness of the compound layer is decreased, but compared with when the average value $K_{NXave}$ is higher than 0.80, the amount of reduction of the thickness of the compound layer is small. That is, in the graph of the average value $K_{NXave}$ and surface hardness (solid line in FIG. 2), there is an inflection point near $K_{NXave}$=0.80.

From the above results, in the present invention, the average value $K_{NXave}$ of the nitriding potential of the high $K_N$ value treatment is made 0.30 to 0.80. By controlling it to this range, the nitrided steel can be raised in surface hardness and the thickness of the compound layer can be suppressed. Furthermore, a sufficient effective hardened layer depth can be obtained. If the average value $K_{NXave}$ is less than 0.30, the compound is insufficiently formed, the surface hardness falls, and a sufficient effective hardened layer depth cannot be obtained. If the average value $K_{NXave}$ exceeds 0.80, sometimes the thickness of the compound layer exceeds 3 μm and, furthermore, the void area ratio becomes 10% or more. The preferable lower limit of the average value $K_{NXave}$ is 0.35. Further, the preferable upper limit of the average value $K_{NXave}$ is 0.70.

(II) Average Value $K_{NYave}$ of Nitriding Potential at Low $K_N$ Value Treatment The average value $K_{NYave}$ of the nitriding potential of the low $K_N$ value treatment is 0.03 to 0.20.

Figure 3:
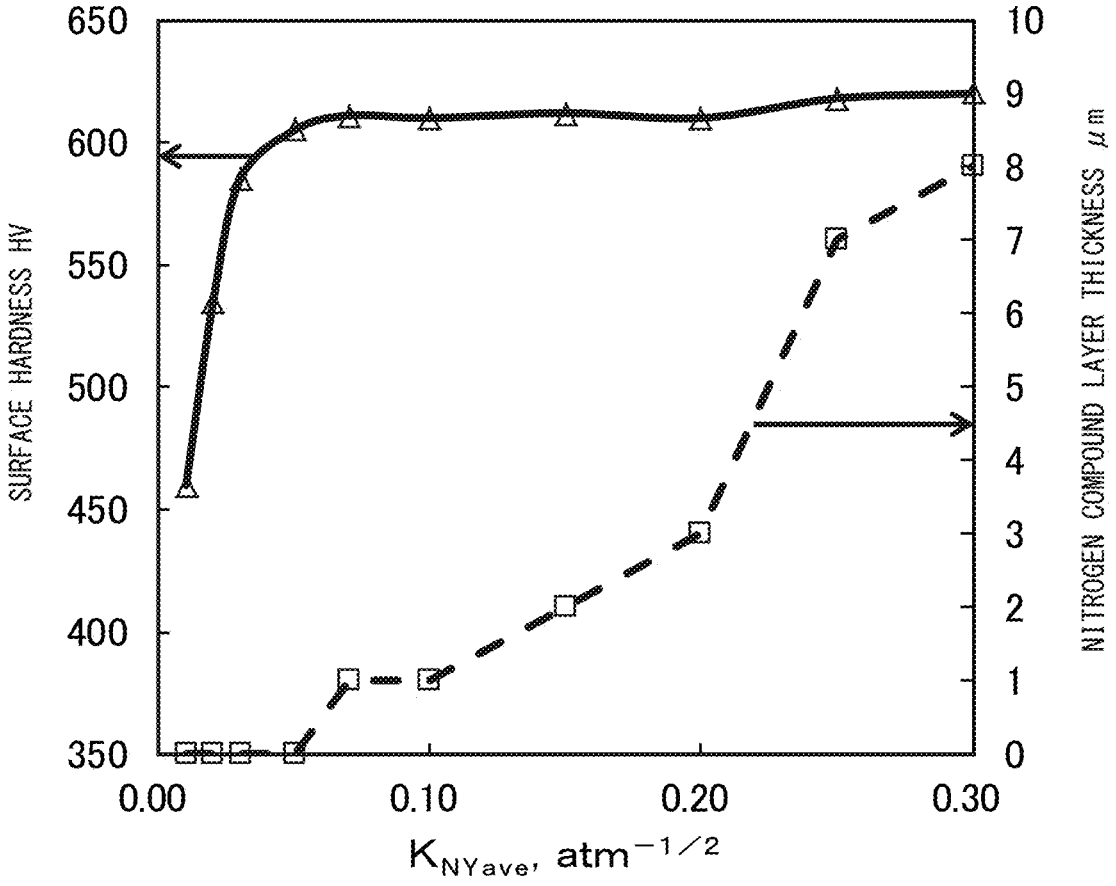
FIG. 3 A view showing a relationship of an average value $K_{NYave}$ of a nitriding potential of a low $K_N$ value treatment and a surface hardness and compound layer thickness.

FIG. 3 is a view showing the relationship of the average value $K_{NYave}$ and the surface hardness and compound layer thickness. FIG. 3 was obtained by the following test.

Steel "a" having the chemical composition prescribed in the present invention was gas nitrided by a temperature of the nitriding atmosphere of 590° C., a treatment time X of 1.0 hour, a treatment time Y of 2.0 hours, an average value $K_{NXave}$ of a constant 0.40, and an average value $K_{NYave}$ changed from 0.01 to 0.30. The overall treatment time A was 3.0 hours.

After the nitriding, the above-mentioned methods were used to measure the surface hardness (HV), effective hardened layer depth (μm), and compound layer thickness (μm) at the different average values $K_{NYave}$. As a result of measurement of the effective hardened layer depth, if the average value $K_{NYave}$ is 0.02 or more, the effective hardened layer depth became 225 μm or more. Furthermore, the surface hardnesses and the compound thicknesses obtained by the measurement tests were plotted to prepare FIG. 3.

The solid line in FIG. 3 is a graph showing the relationship of the average value $K_{NYave}$ and the surface hardness, while the broken line is a graph showing the relationship of the average value $K_{NYave}$ and the depth of the compound layer. Referring to the solid line graph of FIG. 3, as the average value $K_{NYave}$ becomes higher from 0, the surface hardness remarkably increases. Further, when $K_{NYave}$ becomes 0.03, the surface hardness becomes 570 HV or more. Furthermore, when $K_{NYave}$ is 0.03 or more, even if $K_{NYave}$ becomes higher, the surface hardness is substantially constant. Due to the above, in the graph of the average value $K_{NYave}$ and the surface hardness, there is an inflection point near the average value $K_{NYave}$=0.03.

On the other hand, if referring to the broken line graph in FIG. 3, the thickness of the compound layer is substantially constant until the average value $K_{NYave}$ falls from 0.30 to 0.25. However, as the average value $K_{NYave}$ falls from 0.25, the thickness of the compound layer remarkably decreases. Further, when the average value $K_{NYave}$ becomes 0.20, the thickness of the compound layer becomes 3 μm or less. Furthermore, when the average value $K_{NYave}$ is 0.20 or less, as the average value $K_{NYave}$ falls, the thickness of the compound layer decreases, but compared with when the average value $K_{NYave}$ is higher than 0.20, the amount of decrease of the thickness of the compound layer is small. Due to this, in the graph of the average value $K_{NYave}$ and the thickness of the compound layer, there is an inflection point near the average value $K_{NYave}$=0.20.

From the above results, in the present invention, the average value $K_{NYave}$ of the low $K_N$ value treatment is limited to 0.03 to 0.20. In this case, the gas nitrided steel becomes higher in surface hardness and the thickness of the compound layer can be suppressed. Furthermore, it is possible to obtain a sufficient effective hardened layer depth. If the average value $K_{NYave}$ is less than 0.03, nitrogen is removed from the surface and the surface hardness falls. On the other hand, if the average value $K_{NYave}$ exceeds 0.20, the compound insufficiently breaks down, the effective hardened layer depth is shallow, and the surface hardness falls. The preferable lower limit of the average value $K_{NYave}$ is 0.05. The preferable upper limit of the average value $K_{NYave}$ is 0.18.

(III) Scope of Nitriding Potentials $K_{NX}$ and $K_{NY}$ During Nitriding

In gas nitriding, a certain time is required after setting the gas flow rates until the $K_N$ value in the atmosphere reaches the equilibrium state. For this reason, the $K_N$ value changes with each instant until the $K_N$ value reaches the equilibrium state. Furthermore, when shifting from the high $K_N$ value treatment to low $K_N$ value treatment, the setting of the $K_N$ value is changed in the middle of the gas nitriding. In this case as well, the $K_N$ value fluctuates until reaching the equilibrium state.

Such fluctuations in the $K_N$ value have an effect on the compound layer and depth of the hardened layer. Therefore, in the high $K_N$ value treatment and low $K_N$ value treatment, not only are the average value $K_{NXave}$ and average value $K_{NYave}$ made the above ranges, but also the nitriding potential $K_{Nx}$ during the high $K_N$ value treatment and the nitriding potential $K_{NY}$ during the low $K_N$ value treatment are controlled to predetermined ranges.

Specifically, in the present invention, to form a sufficient compound layer, the nitriding potential $K_{NX}$ during the high $K_N$ value treatment is made 0.15 to 1.50. To make the compound layer thin and the depth of the hardened layer larger, the nitriding potential $K_{NY}$ during the low $K_N$ value treatment is made 0.02 to 0.25.

Table 1 shows the compound layer thickness (μm), void area ratio (%), effective hardened layer depth (μm), and surface hardness (HV) of the nitrided part in the case of nitriding steel containing C: 0.15%, Si: 0.51%, Mn: 1.10%, P: 0.015%, S: 0.015%, Cr: 1.20%, Al: 0.028%, and N: 0.008% and having a balance of Fe and impurities (below, referred to as "steel 'a'") by various nitriding potentials $K_{NX}$ and $K_{NY}$. Table 1 was obtained by the following tests.

TABLE 1

| | | High Kn value treatment | | | | Low Kn value treatment | | | |
|---|---|---|---|---|---|---|---|---|---|
| | | | Nitriding potential | | | | Nitriding potential | | |
| Test no. | Temp. (° C.) | Time X (h) | Min. value $Kn_{Xmin}$ | Max. value $Kn_{Xmax}$ | Aver. value $Kn_{Xave}$ | Time Y (h) | Min. value $Kn_{Ymin}$ | Max. value $Kn_{Ymax}$ | Aver. value $Kn_{Yave}$ |
| 1 | 590 | 1.0 | 0.12 | 0.50 | 0.40 | 2.0 | 0.05 | 0.15 | 0.10 |
| 2 | 590 | 1.0 | 0.14 | 0.50 | 0.40 | 2.0 | 0.05 | 0.15 | 0.10 |
| 3 | 590 | 1.0 | 0.15 | 0.50 | 0.40 | 2.0 | 0.05 | 0.15 | 0.10 |
| 4 | 590 | 1.0 | 0.25 | 0.50 | 0.40 | 2.0 | 0.05 | 0.15 | 0.10 |
| 5 | 590 | 1.0 | 0.25 | 1.40 | 0.40 | 2.0 | 0.05 | 0.15 | 0.10 |
| 6 | 590 | 1.0 | 0.25 | 1.50 | 0.40 | 2.0 | 0.05 | 0.15 | 0.10 |
| 7 | 590 | 1.0 | 0.30 | 1.55 | 0.40 | 2.0 | 0.05 | 0.15 | 0.10 |
| 8 | 590 | 1.0 | 0.30 | 1.60 | 0.40 | 2.0 | 0.05 | 0.15 | 0.10 |
| 9 | 590 | 1.0 | 0.30 | 0.50 | 0.40 | 2.0 | 0.01 | 0.15 | 0.10 |
| 10 | 590 | 1.0 | 0.30 | 0.50 | 0.40 | 2.0 | 0.02 | 0.15 | 0.10 |
| 11 | 590 | 1.0 | 0.30 | 0.50 | 0.40 | 2.0 | 0.03 | 0.15 | 0.10 |
| 12 | 590 | 1.0 | 0.30 | 0.50 | 0.40 | 2.0 | 0.05 | 0.15 | 0.10 |

TABLE 1-continued

| | | | | | | | | | |
|---|---|---|---|---|---|---|---|---|---|
| 13 | 590 | 1.0 | 0.30 | 0.50 | 0.40 | 2.0 | 0.05 | 0.20 | 0.10 |
| 14 | 590 | 1.0 | 0.30 | 0.50 | 0.40 | 2.0 | 0.05 | 0.22 | 0.10 |
| 15 | 590 | 1.0 | 0.30 | 0.50 | 0.40 | 2.0 | 0.05 | 0.25 | 0.10 |
| 16 | 590 | 1.0 | 0.30 | 0.50 | 0.40 | 2.0 | 0.05 | 0.27 | 0.10 |

| | Nitriding | | Compound | Void | Effective hardened | |
|---|---|---|---|---|---|---|
| Test no. | Time A (h) | Nitriding potential Aver. value $Kn_{ave}$ | layer thickness (μm) | area ratio (%) | layer depth (actual) (μm) | Surface hardness (Hv) |
| 1 | 3.0 | 0.20 | None | 2 | 195 | 510 |
| 2 | 3.0 | 0.20 | None | 2 | 243 | 535 |
| 3 | 3.0 | 0.20 | 1 | 4 | 241 | 591 |
| 4 | 3.0 | 0.20 | 1 | 4 | 240 | 594 |
| 5 | 3.0 | 0.20 | 2 | 8 | 238 | 600 |
| 6 | 3.0 | 0.20 | 2 | 9 | 241 | 603 |
| 7 | 3.0 | 0.20 | 3 | 15 | 242 | 608 |
| 8 | 3.0 | 0.20 | 5 | 16 | 250 | 607 |
| 9 | 3.0 | 0.20 | None | 3 | 242 | 483 |
| 10 | 3.0 | 0.20 | None | 3 | 243 | 590 |
| 11 | 3.0 | 0.20 | None | 3 | 247 | 590 |
| 12 | 3.0 | 0.20 | 1 | 3 | 241 | 596 |
| 13 | 3.0 | 0.20 | 2 | 4 | 240 | 600 |
| 14 | 3.0 | 0.20 | 2 | 4 | 242 | 599 |
| 15 | 3.0 | 0.20 | 3 | 5 | 244 | 602 |
| 16 | 3.0 | 0.20 | 5 | 5 | 252 | 615 |

Using the steel "a" as a test material, the gas nitriding shown in Table 1 (high $K_N$ value treatment and low $K_N$ value treatment) was performed to produce a nitrided part. Specifically, the atmospheric temperature of the gas nitriding in the different tests was made 590° C., the treatment time X was made 1.0 hour, the treatment time Y was made 2.0 hours, $K_{NXave}$ was made a constant 0.40, and $K_{NYave}$ was made a constant 0.10. Further, during gas nitriding, the minimum values $K_{NXmin}$ and $K_{NYmin}$ and the maximum values $K_{NXmax}$ and $K_{NYmax}$ of $K_{NX}$ and $K_{NY}$ were changed to perform high $K_N$ value treatment and low $K_N$ value treatment. The treatment time A of the nitriding as a whole was made 3.0 hours.

In the case of general gas nitriding where a compound layer of 10 μm or more is formed at a treatment temperature of 570 to 590° C., if making the treatment time of the gas nitriding as a whole 3.0 hours, the effective hardened layer depth became 225 μm±20 μm. The nitride part after gas nitriding was measured for compound layer thickness, void area ratio, effective hardened layer depth, and surface hardness by the above measurement methods to obtain Table 1.

Referring to Table 1, in Test Nos. 3 to 6 and 10 to 15, the minimum value $K_{NXmin}$ and maximum value $K_{NXmax}$ were 0.15 to 1.50 and the minimum value $K_{NYmin}$ and maximum value $K_{NYmax}$ were 0.02 to 0.25. As a result, the compound thickness was a thin 3 μm or less and voids were kept down to less than 10%. Furthermore, the effective hardened layer depth was 225 μm or more, while the surface hardness was 570 HV or more.

On the other hand, in Test Nos. 1 and 2, $K_{NXmin}$ was less than 0.15, so the surface hardness was less than 570 HV. In Test No. 1, furthermore, $K_{NXmin}$ was less than 0.14, so the effective hardened layer depth was less than 225 μm.

In Test Nos. 7 and 8, $K_{NXmax}$ exceeded 1.5, so the voids in the compound layer became 10% or more. In Test No. 8, furthermore, $K_{NXmax}$ exceeded 1.55, so the thickness of the compound layer exceeded 3 μm.

In Test No. 9, $K_{NYmin}$ was less than 0.02, so the surface hardness was less than 570 HV. This is believed because not only was the compound layer eliminated by the low $K_N$ value treatment, but also denitration occurred from the surface layer. Furthermore, in Test No. 16, $K_{NYmax}$ exceeded 0.25. For this reason, the thickness of the compound layer exceeded 3 μm. $K_{NYmax}$ exceeded 0.25, so it is believed that the compound layer did not sufficiently break down.

From the above results, the nitriding potential $K_{NX}$ in the high $K_N$ value treatment is made 0.15 to 1.50 and the nitriding potential $K_{NY}$ in the low $K_N$ value treatment is made 0.02 to 0.25. In this case, in the part after nitriding, the thickness of the compound layer can be made sufficiently thin and voids can be suppressed. Furthermore, the effective hardened layer depth can be made sufficiently deep and a high surface hardness is obtained.

If the nitriding potential $K_{NX}$ is less than 0.15, the effective hardened layer becomes too shallow and the surface hardness becomes too low. If the nitriding potential $K_{NX}$ exceeds 1.50, the compound layer becomes too thick and voids excessively remain.

Further, if the nitriding potential $K_{NY}$ is less than 0.02, denitration occurs and the surface hardness falls. On the other hand, if the nitriding potential $K_{NY}$ is over 0.20, the compound layer becomes too thick. Therefore, in the present embodiment, the nitriding potential $K_{NX}$ during the high $K_N$ value treatment is 0.15 to 1.50, and the nitriding potential $K_{NY}$ in the low $K_N$ value treatment is 0.02 to 0.25.

The preferable lower limit of the nitriding potential $K_{NX}$ is 0.25. The preferable upper limit of $K_{NX}$ is 1.40. The preferable lower limit of $K_{NY}$ is 0.03. The preferable upper limit of $K_{NY}$ is 0.22.

(IV) Average Value $K_{Nave}$ of Nitriding Potential During Nitriding

In gas nitriding of the present embodiment, furthermore, the average value $K_{Nave}$ of the nitriding potential defined by formula (2) is 0.07 to 0.30.

$$K_{Nave}=(X\times K_{NXave}+Y\times K_{NYave})/A \quad (2)$$

Figure 4:
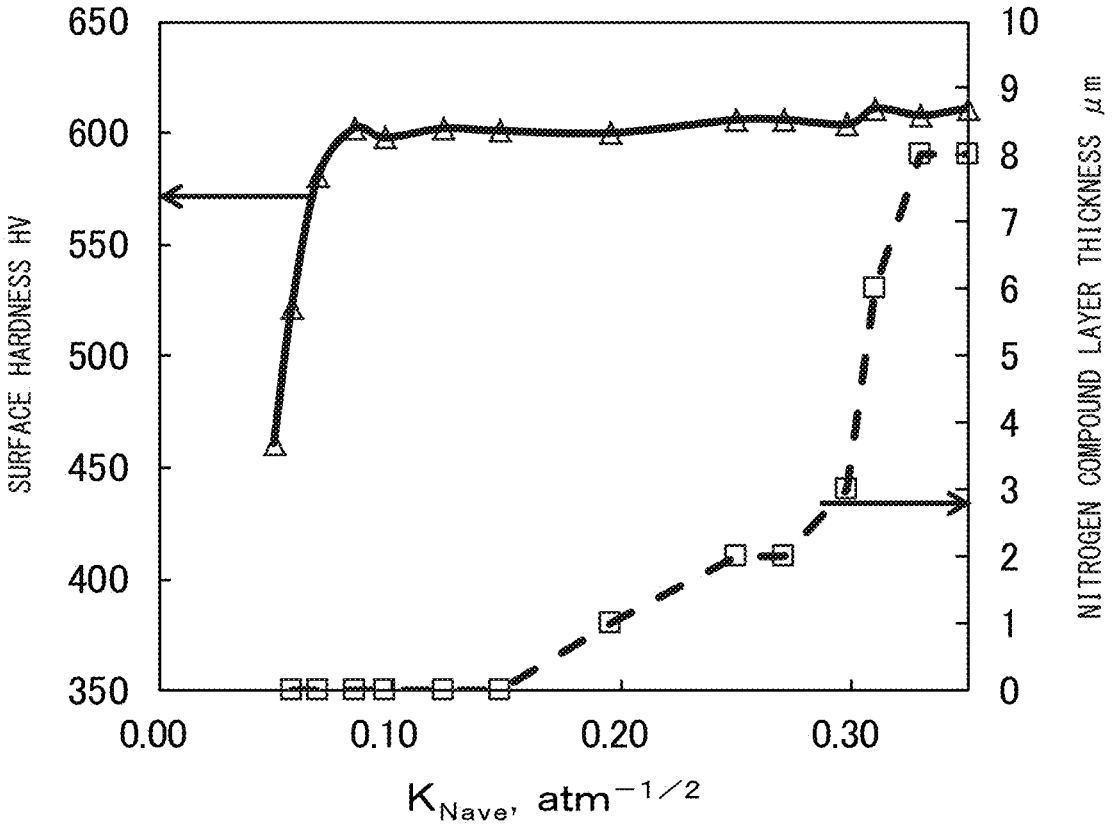
FIG. 4 A view showing a relationship of an average value $K_{Nave}$ of a nitriding potential and a surface hardness and compound layer thickness.

FIG. 4 is a view showing the relationship between the average value $K_{Nave}$, surface hardness (HV), and depth of the compound layer (μm). FIG. 4 was obtained by conducting the following tests. The steel "a" was gas nitrided as a test material. The atmospheric temperature in the gas nitriding was made 590° C. Further, the treatment time X, treatment time Y, and range and average value of the nitriding potential ($K_{NX}$, $K_{NY}$, $K_{NXave}$, $K_{NYave}$) were changed to perform gas nitriding (high $K_N$ value treatment and low $K_N$ value treatment).

The test materials after gas nitriding under the various test conditions were measured for the compound layer thicknesses and surface hardnesses by the above methods. The obtained compound layer thicknesses and surface hardnesses were measured and FIG. 4 was prepared.

The solid line in FIG. 4 is a graph showing the relationship between the average value $K_{Nave}$ of the nitriding potential and the surface hardness (HV). The broken line in FIG. 4 is a graph showing the relationship between the average value $K_{Nave}$ and the thickness of the compound layer (μm).

Referring to the actual line graph of FIG. 4, as the average value $K_{Nave}$ becomes higher from 0, the surface hardness remarkably rises. When the average value $K_{Nave}$ becomes 0.07, the hardness becomes 570 HV or more. Further, if the average value $K_{Nave}$ becomes 0.07 or more, even if the average value $K_{Nave}$ becomes higher, the surface hardness is substantially constant. That is, in the graph of the average value $K_{Nave}$ and surface hardness (HV), there is an inflection point near the average value $K_{Nave}$=0.07.

Furthermore, referring to the broken line graph of FIG. 4, as the average value $K_{Nave}$ falls from 0.35, the compound thickness becomes remarkably thinner. When the average value $K_{Nave}$ becomes 0.30, it becomes 3 μm or less. Further, if the average value $K_{Nave}$ becomes less than 0.30, as the average value $K_{Nave}$ becomes lower, the compound thickness gradually becomes thinner, but compared with the case where the average value $K_{Nave}$ is higher than 0.30, the amount of reduction of the thickness of the compound layer is small. Due to the above, in the graph of the average value $K_{Nave}$ and the thickness of the compound layer, there is an inflection point near the average value $K_{Nave}$=0.30.

From the above results, with the gas nitriding of the present embodiment, the average value $K_{Nave}$ defined by formula (2) is made 0.07 to 0.30. In this case, in the gas nitrided part, the compound layer can be made sufficiently thin. Furthermore, a high surface hardness is obtained. If the average value $K_{Nave}$ is less than 0.07, the surface hardness is low. On the other hand, if the average value $K_{Nave}$ is over 0.30, the compound layer exceeds 3 μm. The preferable lower limit of the average value $K_{Nave}$ is 0.08. The preferable upper limit of the average value $K_{Nave}$ is 0.27.

Treatment Time of High $K_N$ Value Treatment and Low $K_N$ Value Treatment

The treatment time X of the high $K_N$ value treatment and the treatment time Y of the low $K_N$ value treatment are not particularly limited so long as the average value $K_{Nave}$ defined by the formula (2) is 0.07 to 0.30. Preferably, the treatment time X is 0.50 hour or more and the treatment time Y is 0.50 hour or more.

Gas nitriding is performed under the above conditions. Specifically, high $K_N$ value treatment is performed under the above conditions, then low $K_N$ value treatment is performed under the above conditions. After the low $K_N$ value treatment, gas nitriding is ended without raising the nitriding potential.

The steel having the components prescribed in the present invention is gas nitrided to thereby produce a nitrided part. In the nitrided part produced, the surface hardness is sufficiently deep and the compound layer is sufficiently thin. Furthermore, the effective hardened layer depth can be made sufficiently deep and voids in the compound layer can also be suppressed. Preferably, in the nitrided part produced by nitriding in the present embodiment, the surface hardness becomes a Vickers hardness of 570 HV or more and the depth of the compound layer becomes 3 μm or less. Furthermore, the void area ratio becomes less than 10%. Furthermore, the effective hardened layer depth becomes 160 to 410 μm.

EXAMPLES

Steels "a" to "z" having the chemical components shown in Table 2 were melted in 50 kg amounts in a vacuum melting furnace to produce molten steels. The molten steels were cast to produce ingots. Note that, in Table 2, "a" to "q" are steels having the chemical components prescribed in the present invention. On the other hand, steels "r" to "z" were steels of comparative examples off from the chemical components prescribed in the present invention in at least one element.

TABLE 2

| | Chemical components (mass %)*1 | | | | | | | | | | | | | |
|---|---|---|---|---|---|---|---|---|---|---|---|---|---|---|
| Steel | C | Si | Mn | P | S | Cr | Al | N | Mo | Cu | Ni | V | Ti | Remarks |
| a | 0.15 | 0.26 | 1.26 | 0.011 | 0.010 | 1.62 | 0.026 | 0.015 | | | | | | Inv. ex. |
| b | 0.24 | 0.20 | 0.95 | 0.012 | 0.012 | 1.15 | 0.024 | 0.010 | 0.25 | | | | | |
| c | 0.12 | 1.32 | 0.88 | 0.014 | 0.021 | 1.23 | 0.020 | 0.013 | | 0.25 | | | | |
| d | 0.10 | 0.35 | 2.34 | 0.010 | 0.008 | 0.99 | 0.023 | 0.015 | | | 0.30 | | | |
| e | 0.20 | 0.53 | 0.87 | 0.019 | 0.031 | 1.35 | 0.020 | 0.018 | | | | 0.18 | | |
| f | 0.16 | 1.03 | 0.66 | 0.009 | 0.013 | 1.82 | 0.025 | 0.014 | | 0.18 | | | 0.010 | |
| g | 0.13 | 0.65 | 1.45 | 0.009 | 0.016 | 0.79 | 0.042 | 0.024 | 0.22 | | | | 0.006 | |
| h | 0.17 | 0.42 | 0.91 | 0.010 | 0.010 | 1.11 | 0.023 | 0.012 | 0.15 | | 0.17 | | | |
| i | 0.16 | 0.24 | 0.41 | 0.009 | 0.026 | 1.33 | 0.026 | 0.017 | | 0.20 | | 0.41 | | |
| j | 0.09 | 0.20 | 1.51 | 0.010 | 0.011 | 1.13 | 0.020 | 0.006 | 0.49 | 0.25 | | | | |
| k | 0.06 | 0.29 | 1.01 | 0.015 | 0.021 | 1.16 | 0.021 | 0.009 | | 0.11 | 0.26 | 0.22 | | |
| l | 0.19 | 0.07 | 0.96 | 0.016 | 0.006 | 1.09 | 0.022 | 0.008 | 0.22 | | | | 0.012 | |
| m | 0.16 | 0.30 | 0.32 | 0.012 | 0.010 | 1.66 | 0.033 | 0.008 | | 0.35 | | | 0.008 | |
| n | 0.14 | 0.45 | 1.85 | 0.011 | 0.007 | 0.58 | 0.021 | 0.017 | 0.44 | | 0.10 | | 0.011 | |
| o | 0.17 | 0.33 | 0.95 | 0.010 | 0.010 | 1.08 | 0.018 | 0.004 | | 0.18 | 0.22 | | 0.009 | |
| p | 0.11 | 0.25 | 1.01 | 0.008 | 0.006 | 0.95 | 0.022 | 0.009 | 0.15 | 0.16 | 0.05 | 0.08 | | |
| q | 0.07 | 0.07 | 0.36 | 0.015 | 0.015 | 0.54 | 0.025 | 0.015 | 0.45 | 0.48 | 0.26 | 0.35 | 0.008 | |
| r | 0.26 | 0.32 | 1.23 | 0.015 | 0.020 | 1.13 | 0.031 | 0.010 | | | | | | Comp. ex. |
| s | 0.04 | 0.35 | 1.02 | 0.015 | 0.013 | 1.10 | 0.021 | 0.012 | | | | | | |
| t | 0.19 | 0.04 | 1.35 | 0.013 | 0.041 | 0.88 | 0.019 | 0.004 | | 0.16 | | | | |
| u | 0.18 | 0.77 | 0.19 | 0.013 | 0.012 | 0.94 | 0.021 | 0.011 | 0.10 | | | 0.30 | | |

TABLE 2-continued

| Steel | Chemical components (mass %)*1 | | | | | | | | | | | | | |
|---|---|---|---|---|---|---|---|---|---|---|---|---|---|---|
| | C | Si | Mn | P | S | Cr | Al | N | Mo | Cu | Ni | V | Ti | Remarks |
| v | 0.10 | 0.36 | 0.80 | 0.026 | 0.051 | 1.15 | 0.034 | 0.007 | 0.23 | | 0.20 | | 0.016 | |
| w | 0.23 | 1.22 | 1.54 | 0.014 | 0.022 | 0.48 | 0.021 | 0.006 | 0.11 | | | | 0.008 | |
| x | 0.15 | 0.78 | 0.40 | 0.014 | 0.008 | 1.13 | 0.052 | 0.015 | | 0.25 | | | | |
| y | 0.24 | 1.28 | 0.18 | 0.011 | 0.010 | 0.47 | 0.025 | 0.011 | 0.05 | 0.06 | 0.41 | 0.48 | | |
| z | 0.06 | 0.06 | 2.55 | 0.024 | 0.048 | 2.03 | 0.049 | 0.003 | | | | | | |

*1Balance of chemical components is Fe and impurities.

*2. Empty fields indicate alloy element not intentionally added.

The ingots were hot forged to rods of a diameter of 35 mm. Next, rods were annealed, then machined to prepare plate-shaped test pieces for evaluation of the thickness of the compound layer, volume ratio of the voids, effective hardened layer depth, and surface hardness. The plate shaped test pieces were made vertical 20 mm, horizontal 20 mm, and thickness 2 mm. Further, small rollers for roller pitting test use for evaluating the pitting resistance shown in FIG. 5 and large rollers shown in FIG. 6 were prepared. Furthermore, columnar test pieces were prepared for evaluating the bending fatigue resistance shown in FIG. 7.

The obtained test pieces were gas nitrided under the next conditions. The test pieces were loaded into a gas nitriding furnace then $NH_3$, $H_2$, and $N_2$ gases were introduced into the furnace. After that, the high $K_N$ value treatment was performed, then the low $K_N$ value treatment was performed under the conditions of Tables 3 and 4. The test pieces after gas nitriding were oil cooled using 80° C. oil.

TABLE 3

| Test no. | Steel | Temp. (° C.) | Nitriding potential: High Kn value treatment: Time X (h) | Nitriding potential: Min. value $Kn_{Xmin}$ | Max. value $Kn_{Xmax}$ | Aver. value $Kn_{Xave}$ | Low Kn value treatment: Time Y (h) | Nitriding potential: Min. value $Kn_{Ymin}$ | Max. value $Kn_{Ymax}$ | Aver. value $Kn_{Yave}$ | Overall: Time A (h) | Nitriding potential Aver. value $Kn_{ave}$ |
|---|---|---|---|---|---|---|---|---|---|---|---|---|
| 17 | a | 590 | 2.0 | 0.26 | 0.51 | 0.38 | 3.0 | 0.03 | 0.10 | 0.05 | 5.0 | 0.18 |
| 18 | a | 590 | 2.0 | 0.20 | 0.50 | 0.33 | 2.0 | 0.03 | 0.15 | 0.12 | 4.0 | 0.23 |
| 19 | a | 590 | 1.5 | 0.22 | 0.60 | 0.33 | 8.0 | 0.10 | 0.25 | 0.15 | 9.5 | 0.18 |
| 20 | a | 590 | 1.0 | 0.18 | 1.00 | 0.50 | 4.0 | 0.03 | 0.15 | 0.10 | 5.0 | 0.18 |
| 21 | a | 590 | 0.5 | 0.56 | 1.48 | 0.78 | 4.5 | 0.03 | 0.11 | 0.05 | 5.0 | 0.12 |
| 22 | a | 590 | 0.5 | 0.20 | 1.48 | 0.35 | 4.5 | 0.03 | 0.20 | 0.19 | 5.0 | 0.21 |
| 23 | a | 590 | 0.5 | 0.15 | 0.88 | 0.50 | 4.5 | 0.03 | 0.08 | 0.04 | 5.0 | 0.09 |
| 24 | a | 590 | 2.0 | 0.25 | 1.35 | 0.60 | 3.0 | 0.05 | 0.15 | 0.08 | 5.0 | 0.29 |
| 25 | a | 590 | 0.5 | 0.16 | 0.66 | 0.35 | 4.0 | 0.02 | 0.12 | 0.03 | 4.5 | 0.07 |
| 26 | b | 590 | 2.0 | 0.25 | 0.74 | 0.43 | 3.0 | 0.05 | 0.15 | 0.05 | 5.0 | 0.20 |
| 27 | c | 590 | 2.0 | 0.29 | 0.78 | 0.42 | 3.0 | 0.04 | 0.18 | 0.12 | 5.0 | 0.24 |
| 28 | d | 590 | 2.0 | 0.28 | 0.66 | 0.39 | 3.0 | 0.10 | 0.24 | 0.17 | 5.0 | 0.26 |
| 29 | e | 590 | 2.0 | 0.18 | 0.78 | 0.30 | 5.0 | 0.02 | 0.18 | 0.03 | 7.0 | 0.11 |
| 30 | f | 590 | 2.0 | 0.28 | 0.90 | 0.35 | 3.0 | 0.05 | 0.16 | 0.06 | 5.0 | 0.18 |
| 31 | g | 590 | 1.5 | 0.18 | 1.47 | 0.79 | 3.5 | 0.02 | 0.24 | 0.09 | 5.0 | 0.30 |
| 32 | h | 590 | 2.0 | 0.31 | 1.20 | 0.60 | 3.0 | 0.03 | 0.17 | 0.05 | 5.0 | 0.27 |
| 33 | i | 590 | 1.0 | 0.28 | 0.77 | 0.65 | 5.0 | 0.05 | 0.15 | 0.06 | 6.0 | 0.16 |
| 34 | j | 590 | 2.0 | 0.38 | 0.90 | 0.59 | 3.0 | 0.03 | 0.16 | 0.05 | 5.0 | 0.27 |
| 35 | k | 590 | 2.0 | 0.18 | 0.77 | 0.40 | 3.0 | 0.05 | 0.18 | 0.07 | 5.0 | 0.20 |
| 36 | l | 590 | 1.0 | 0.22 | 0.81 | 0.50 | 4.0 | 0.05 | 0.20 | 0.08 | 5.0 | 0.16 |
| 37 | m | 590 | 1.0 | 0.35 | 0.99 | 0.60 | 4.0 | 0.02 | 0.15 | 0.04 | 5.0 | 0.15 |
| 38 | n | 590 | 2.0 | 0.28 | 0.61 | 0.31 | 3.0 | 0.03 | 0.23 | 0.05 | 5.0 | 0.15 |
| 39 | o | 590 | 2.0 | 0.26 | 0.65 | 0.35 | 3.0 | 0.04 | 0.16 | 0.06 | 5.0 | 0.18 |
| 40 | p | 590 | 2.0 | 0.29 | 0.75 | 0.38 | 3.0 | 0.03 | 0.18 | 0.05 | 5.0 | 0.18 |
| 41 | q | 590 | 2.0 | 0.29 | 0.68 | 0.40 | 3.0 | 0.03 | 0.20 | 0.06 | 5.0 | 0.20 |

| Test no. | Comp. layer thick. (μm) | γ' phase area ratio (%) | Void area ratio (%) | Eff. hardened layer depth (target) (μm) | Eff. hardened layer depth (actual) (μm) | Surface hardness (Hv) | Pitting strength (MPa) | Rotating bending fatigue strength (MPa) | Remarks |
|---|---|---|---|---|---|---|---|---|---|
| 17 | 0 | — | 0 | 291 | 308 | 705 | 1800 | 570 | Inv. ex. |
| 18 | 1 | 85 | 4 | 260 | 277 | 703 | 1850 | 560 | |
| 19 | 2 | 85 | 5 | 401 | 422 | 676 | 1800 | 570 | |
| 20 | 1 | 85 | 5 | 291 | 311 | 705 | 1850 | 560 | |
| 21 | 0 | — | 8 | 291 | 306 | 708 | 1850 | 560 | |
| 22 | 1 | 85 | 9 | 291 | 310 | 699 | 1850 | 580 | |
| 23 | 0 | — | 4 | 291 | 305 | 642 | 1900 | 570 | |
| 24 | 3 | 70 | 9 | 291 | 308 | 710 | 1800 | 590 | |
| 25 | 0 | — | 0 | 276 | 280 | 612 | 1800 | 560 | |
| 26 | 3 | 80 | 4 | 291 | 310 | 731 | 1900 | 590 | |

TABLE 3-continued

| | | | | | | | | |
|---|---|---|---|---|---|---|---|---|
| 27 | 2 | 80 | 2 | 291 | 325 | 744 | 1950 | 600 |
| 28 | 3 | 70 | 3 | 291 | 319 | 650 | 1850 | 580 |
| 29 | 0 | — | 0 | 344 | 352 | 572 | 1800 | 550 |
| 30 | 2 | 75 | 6 | 291 | 310 | 801 | 1900 | 590 |
| 31 | 3 | 60 | 9 | 291 | 308 | 581 | 1800 | 560 |
| 32 | 3 | 70 | 8 | 291 | 315 | 598 | 1850 | 560 |
| 33 | 0 | — | 6 | 318 | 338 | 652 | 1900 | 590 |
| 34 | 2 | 65 | 5 | 291 | 312 | 794 | 2000 | 620 |
| 35 | 1 | 85 | 5 | 291 | 310 | 635 | 1950 | 600 |
| 36 | 2 | 85 | 4 | 291 | 313 | 592 | 1850 | 560 |
| 37 | 2 | 90 | 5 | 291 | 309 | 761 | 1900 | 620 |
| 38 | 1 | 85 | 6 | 291 | 302 | 603 | 1850 | 560 |
| 39 | 1 | 85 | 4 | 291 | 315 | 625 | 1900 | 560 |
| 40 | 1 | 85 | 2 | 291 | 310 | 617 | 2050 | 620 |
| 41 | 0 | — | 2 | 291 | 305 | 645 | 2100 | 630 |

TABLE 4

(Continuation of Table 3)

| | | | Nitriding potential | | | | | | | | | |
|---|---|---|---|---|---|---|---|---|---|---|---|---|
| | | | High Kn value treatment | | | | Low Kn value treatment | | | | | |
| | | | | Nitriding potential | | | | Nitriding potential | | | Overall | |
| Test no. | Steel | Temp. (° C.) | Time X (h) | Min. value $Kn_{Xmin}$ | Max. value $Kn_{Xmax}$ | Aver. value $Kn_{Xave}$ | Time Y (h) | Min. value $Kn_{Ymin}$ | Max. value $Kn_{Ymax}$ | Aver. value $Kn_{Yave}$ | Time A (h) | Nitriding potential Aver. value $Kn_{ave}$ |
| 42 | a | 590 | 0.5 | 0.14 | 0.65 | 0.35 | 1.0 | 0.03 | 0.23 | 0.06 | 1.5 | 0.16 |
| 43 | a | 590 | 2.0 | 0.25 | 1.53 | 0.68 | 3.0 | 0.02 | 0.15 | 0.04 | 5.0 | 0.30 |
| 44 | a | 590 | 0.5 | 0.16 | 0.59 | 0.29 | 1.0 | 0.03 | 0.18 | 0.06 | 1.5 | 0.14 |
| 45 | a | 590 | 1.5 | 0.28 | 0.93 | 0.82 | 3.5 | 0.02 | 0.13 | 0.03 | 5.0 | 0.27 |
| 46 | a | 590 | 0.5 | 0.15 | 0.50 | 0.31 | 1.0 | 0.01 | 0.08 | 0.03 | 1.5 | 0.12 |
| 47 | a | 590 | 0.5 | 0.20 | 0.55 | 0.35 | 1.0 | 0.00 | 0.03 | 0.02 | 1.5 | 0.13 |
| 48 | a | 590 | 0.5 | 0.18 | 0.32 | 0.31 | 4.5 | 0.02 | 0.05 | 0.03 | 5.0 | 0.06 |
| 49 | a | 590 | 1.0 | 0.17 | 0.99 | 0.66 | 4.0 | 0.13 | 0.24 | 0.21 | 5.0 | 0.30 |
| 50 | a | 590 | 3.0 | 0.18 | 0.95 | 0.49 | 2.0 | 0.02 | 0.05 | 0.03 | 5.0 | 0.31 |
| 51 | a | 590 | 2.0 | 0.15 | 1.38 | 0.30 | | | | | 2.0 | 0.30 |
| 52 | r | 590 | 2.0 | 0.58 | 1.15 | 0.69 | 3.0 | 0.03 | 0.15 | 0.04 | 5.0 | 0.30 |
| 53 | s | 590 | 2.0 | 0.32 | 0.95 | 0.55 | 3.0 | 0.04 | 0.19 | 0.06 | 5.0 | 0.26 |
| 54 | t | 590 | 2.0 | 0.30 | 0.93 | 0.50 | 3.0 | 0.05 | 0.17 | 0.06 | 5.0 | 0.24 |
| 55 | u | 590 | 2.0 | 0.35 | 0.88 | 0.45 | 3.0 | 0.03 | 0.20 | 0.05 | 5.0 | 0.21 |
| 56 | v | 590 | 2.0 | 0.20 | 0.78 | 0.40 | 3.0 | 0.03 | 0.20 | 0.08 | 5.0 | 0.21 |
| 57 | w | 590 | 2.0 | 0.25 | 0.90 | 0.45 | 3.0 | 0.05 | 0.21 | 0.10 | 5.0 | 0.24 |
| 58 | x | 590 | 2.0 | 0.28 | 0.95 | 0.51 | 3.0 | 0.04 | 0.20 | 0.06 | 5.0 | 0.24 |
| 59 | y | 590 | 2.0 | 0.35 | 0.96 | 0.55 | 3.0 | 0.03 | 0.19 | 0.05 | 5.0 | 0.25 |
| 60 | z | 590 | 0.5 | 0.30 | 0.90 | 0.59 | 1.0 | 0.03 | 0.20 | 0.08 | 1.5 | 0.25 |

| Test no. | Comp. layer thick. (μm) | γ' phase area ratio (%) | Void area ratio (%) | Eff. hardened layer depth (target) (μm) | Eff. hardened layer depth (actual) (μm) | Surface hardness (Hv) | Pitting strength (MPa) | Rotating bending fatigue strength (MPa) | Remarks |
|---|---|---|---|---|---|---|---|---|---|
| 42 | 0 | — | 0 | 160 | 155 | 580 | 1600 | 520 | Comp. ex. |
| 43 | 3 | 50 | 15 | 291 | 305 | 622 | 1700 | 510 | |
| 44 | 0 | — | 0 | 160 | 151 | 552 | 1500 | 490 | |
| 45 | 7 | 40 | 13 | 291 | 306 | 699 | 1650 | 520 | |
| 46 | 0 | — | 0 | 160 | 156 | 558 | 1550 | 490 | |
| 47 | 0 | — | 0 | 160 | 154 | 546 | 1500 | 500 | |
| 48 | 0 | — | 0 | 291 | 265 | 555 | 1500 | 510 | |
| 49 | 12 | 30 | 9 | 291 | 311 | 675 | 1600 | 530 | |
| 50 | 9 | 35 | 7 | 291 | 306 | 678 | 1500 | 480 | |
| 51 | 8 | 40 | 9 | 184 | 195 | 585 | 1750 | 520 | |
| 52 | 5 | 45 | 8 | 291 | 321 | 596 | 1700 | 580 | |
| 53 | 3 | 70 | 4 | 291 | 302 | 605 | 1650 | 540 | |
| 54 | 2 | 60 | 3 | 291 | 308 | 612 | 1750 | 570 | |
| 55 | 3 | 60 | 6 | 291 | 310 | 541 | 1700 | 610 | |
| 56 | 3 | 55 | 6 | 291 | 305 | 610 | 1750 | 510 | |
| 57 | 3 | 65 | 6 | 291 | 316 | 534 | 1700 | 620 | |
| 58 | 3 | 65 | 5 | 291 | 310 | 632 | 1900 | 470 | |
| 59 | 2 | 70 | 5 | 291 | 308 | 464 | 1450 | 680 | |
| 60 | 0 | — | 0 | 160 | 125 | 845 | 1550 | 440 | |

Test for Measurement of Thickness of Compound Layer and Void Area Ratio

The cross-sections of test pieces after gas nitriding in a direction vertical to the length direction were polished to mirror surfaces and etched. An optical microscope was used to examine the etched cross-sections, measure the compound layer thicknesses, and check for the presence of any voids in the surface layer parts. The etching was performed by a 3% Nital solution for 20 to 30 seconds.

The compound layers can be confirmed as white uncorroded layers present at the surface layers. The compound layers were examined from five fields of photographed structures taken at 500× (field area: $2.2\times10^4$ $\mu m^2$). The thicknesses of the compound layers at four points were measured every 30 μm. Further, the average values of the 20 points measured were defined as the compound thicknesses (μm).

Furthermore, the etched cross-sections were examined at 1000× in five fields and the ratios of the total areas of the voids in areas of 25 $\mu m^2$ in the ranges of 5 pin depth from the outermost surface (void area ratio, unit: %) were found.

Test for Measurement of Surface Hardness and Effective Hardened Layer

The steel rods of the different tests after gas nitriding were measured for Vickers hardnesses based on JIS Z 2244 by test forces of 1.96N at 50 μm, 100 μm, and every subsequent 50 μm increments from the surfaces until depths of 1000 μm. The Vickers hardnesses (HV) were measured at five points each and the average values were found. The surface hardnesses were made the average values of five points at positions of 50 μm from the surfaces.

The depths of ranges becoming 300 HV or more in the distribution of Vickers hardnesses measured in the depth direction from the surfaces were defined as the effective hardened layer depths (μm).

If the thicknesses of the compound layers are 3 μm or less, the ratios of voids are less than 10%, and the surface hardnesses are 570 HV or more, the test pieces are judged as good. Furthermore, if the effective hardened layer depths are 160 to 410 μm, the test pieces are judged as good.

Below, good and poor test pieces were used to evaluate the pitting resistances, bending resistances, and rotating bending fatigue resistances.

Test for Evaluation of Pitting Resistance

Figure 5:
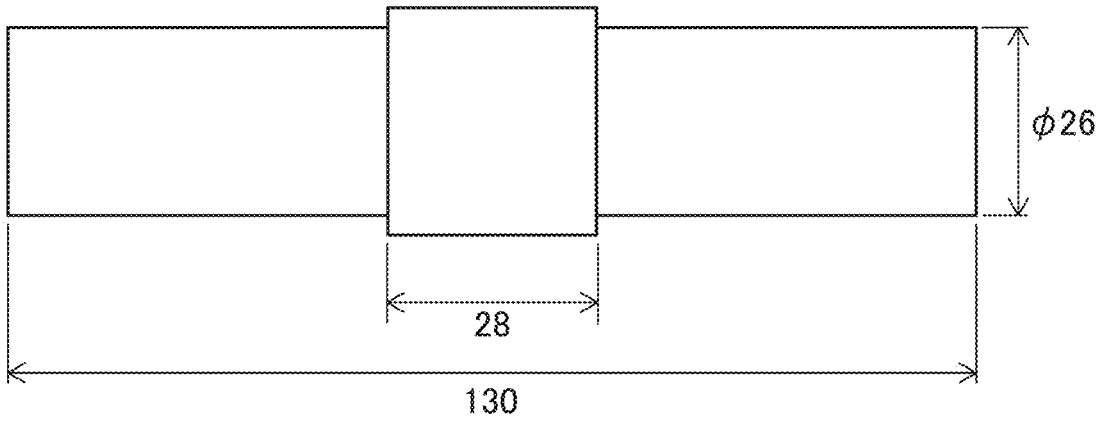
FIG. 5 The shape of a small roller for roller pitting test use used for evaluating a pitting resistance.
Figure 6:
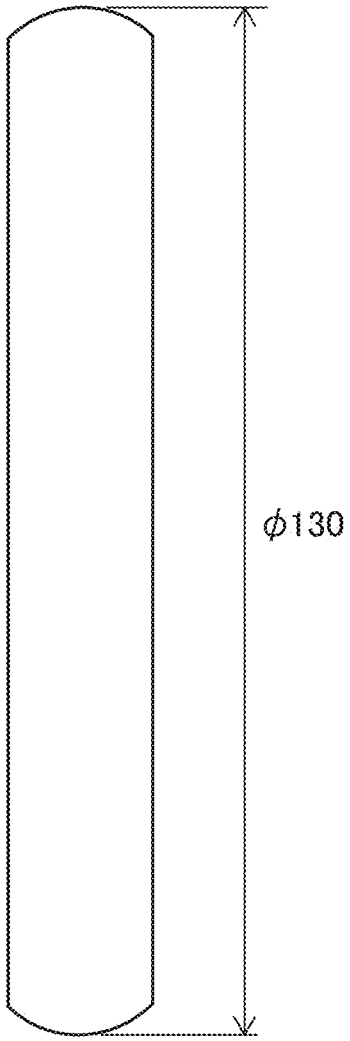
FIG. 6 The shape of a large roller for roller pitting test use used for evaluating a pitting resistance.

The small rollers for the roller pitting test use of the tests after gas nitriding were finished at the gripping parts for the purpose of removing the heat treatment strains, then were used as roller pitting test pieces. The shapes after finishing are shown in FIG. 5. The pitting fatigue tests were performed by combining the small rollers for roller pitting test use and the large rollers for roller pitting test use of the shapes shown in FIG. 6. Note that, in FIGS. 5 and 6, the units of the dimensions are "mm".

The above large rollers for roller pitting test use were fabricated using steel satisfying the standard of JIS SCM420 by a general production process, that is, a process of "normalizing→working test piece→eutectoid carburizing by a gas carburizing furnace→low temperature tempering→polishing". The Vickers hardnesses Hv at positions of 0.05 mm from the surfaces, that is, positions of depths of 0.05 mm, were 740 to 760. Further, the depths where the Vickers hardnesses Hv were 550 or more were 0.8 to 1.0 mm in range.

Table 5 shows the conditions of the pitting fatigue tests. The cutoffs of the tests were made $10^7$ cycles showing the fatigue limit of general steel. The maximum surface pressures in small roller test pieces where no pitting occurs and $10^7$ cycles were reached were made the fatigue limits of the small roller test pieces. The occurrence of pitting was detected by a vibration meter provided at the test machine. After the occurrence of vibration, the rotations of both the small roller test pieces and large roller test pieces were stopped and the occurrence of pitting and rotational speeds were checked for. In a part of the present invention, a maximum surface pressure at the fatigue limit of 1800 MPa or more was targeted.

TABLE 5

| | |
|---|---|
| Tester | Roller pitting tester |
| Test piece size | Small roller: diameter 26 mm<br>Large roller: diameter 130 mm<br>Contact part 150 mmR |
| Surface pressure | 1500 to 2400 MPa |
| No. of tests | 5 |
| Slip ratio | −40% |
| Small roller speed | 1500 rpm |
| Circumferential speed | Small roller: 123 m/min<br>Large roller: 172 m/min |
| Lubrication oil | Type: oil for automatic transmission use<br>Oil temperature: 90° C. |

Test for Evaluation of Bending Fatigue Resistance

Figure 7:
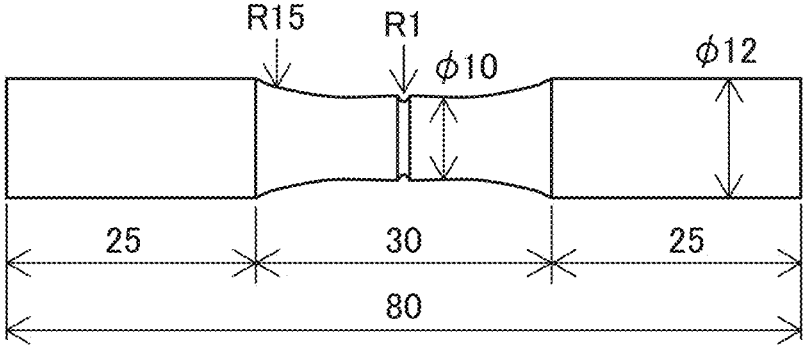
FIG. 7 A columnar test piece for evaluating bending fatigue resistance.

Columnar test pieces used for gas nitriding were tested by an Ono-type rotating bending fatigue test. The speed was 3000 rpm, the cutoff of the test was made $10^7$ cycles showing the fatigue limit of general steel, and the maximum stress amplitude in a rotating bending fatigue test piece when reaching $10^7$ cycles without fracture was made the fatigue limit of the rotating bending fatigue test piece. The shapes of the test pieces are shown in FIG. 7. In a part of the present invention, the target is a maximum stress at the fatigue limit of 550 MPa or more.

Test Results

The results are shown in Table 3. In Tables 3 and 4, the "Effective hardened layer depth (target)" column describes the values calculated by the formula (A) (target value), while the "Effective hardened layer depth (actual)" describes the measured values of the effective hardened layer (μm).

Referring to Tables 3 and 4, in Test Nos. 17 to 41, the treatment temperatures in gas nitriding were 550 to 620° C. and the treatment times A were 1.5 to 10 hours. Furthermore, the $K_{NX}$'s at the high $K_N$ value treatment were 0.15 to 1.50, while the average values $K_{NXave}$'s were 0.30 to 0.80. Furthermore, the $K_{NY}$'s at the low $K_N$ value treatment were 0.02 to 0.25, while the average values $K_{NYave}$'s were 0.03 to 0.20. Furthermore, the average values $K_{Nave}$'s found by formula (2) were 0.07 to 0.30. For this reason, in each test, the thicknesses of the compound layers after nitriding were 3 μm or less, while the void area ratios were less than 10%.

Furthermore, the effective hardened layers satisfied 160 to 410 μm and the surface hardnesses was 570 HV or more. Both the pitting strengths and bending fatigue strengths satisfied their targets of 1800 MPa and 550 MPa or more. Note that the cross-sections of the surface layers of the test pieces with the compound layers were investigated for phase structures of the compound layers by the SEM-EBSD method, whereupon by area ratio, the γ"s ($Fe_4N$) were 50% or more and the balances were ε ($Fe_{2-3}N$).

On the other hand, in Test No. 42, the minimum value of $K_{NX}$ at the high $K_N$ value treatment was less than 0.15. For this reason, a compound layer was not stably formed during the high $K_N$ value treatment, so the effective hardened layer depth became less than 160 μm, the pitting strength was less than 1800 MPa, and the bending fatigue strength was less than 550 MPa.

In Test No. 43, the maximum value of $K_{NX}$ at the high $K_N$ value treatment exceeded 1.50. For this reason, the void area ratio became 10% or more, the pitting strength was less than 1800 MPa, and the bending fatigue strength was less than 550 MPa.

In Test No. 44, the average value $K_{NXave}$ in the high $K_N$ value treatment was less than 0.30. For this reason, a compound layer of a sufficient thickness was not formed during the high $K_N$ value treatment and the compound layer ended up breaking down at the early stage of the low $K_N$ value treatment, so the effective hardened layer depth became less than 160 μm and the surface hardness also was less than 570 HV, so the pitting strength was less than 1800 MPa and the bending fatigue strength was less than 550 MPa.

In Test No. 45, the average value $K_{NXave}$ at the high $K_N$ value treatment exceeded 0.80. For this reason, the compound layer thickness exceeded 3 μm, the void area ratio became 10% or more, the pitting strength was less than 1800 MPa, and the bending fatigue strength was less than 550 MPa.

In Test No. 46, the minimum value of $K_{NY}$ at the low $K_N$ value treatment was less than 0.02. For this reason, at the early stage of the low $K_N$ value treatment, the compound layer ended up breaking down, so the effective hardened layer depth became less than 160 μm and the surface hardness also was less than 570 HV, so the pitting strength was less than 1800 MPa and the bending fatigue strength was less than 550 MPa.

In Test No. 47, the minimum value of $K_{NY}$ at the low $K_N$ value treatment was less than 0.02, and the average value $K_{Yave}$ at the low $K_N$ value treatment was less than 0.03. For this reason, the effective hardened layer depth became less than 160 μm and the surface hardness was also less than 570 HV, so the pitting strength was less than 1800 MPa and the bending fatigue strength was less than 550 MPa.

In Test No. 48, the average value $K_{Nave}$ was less than 0.07. For this reason, the surface hardness was less than 570 HV, so the pitting strength was less than 1800 MPa and the bending fatigue strength was less than 550 MPa.

In Test No. 49, the average value $K_{Yave}$ at the low $K_N$ value treatment exceeded 0.20. For this reason, the compound layer thickness exceeded 3 μm, so the pitting strength was less than 1800 MPa and the bending fatigue strength was less than 550 MPa.

In Test No. 50, the average value $K_{Nave}$ exceeded 0.30. For this reason, the compound layer thickness exceeded 3 μm, so the pitting strength was less than 1800 MPa and the bending fatigue strength was less than 550 MPa.

In Test No. 51, no high low $K_N$ value treatment was performed and the average value $K_{Nave}$ was controlled to 0.07 to 0.30. As a result, the compound layer thickness exceeded 3 μm, so the pitting strength became less than 1800 MPa and the bending fatigue strength became less than 550 MPa.

In Test Nos. 52 to 60, steels "r" to "z" having components outside the scope prescribed in the present invention were used and nitrided as prescribed in the present invention. As a result, at least one of the pitting strength and bending fatigue strength failed to meet the target value.

Above, embodiments of the present invention were explained. However, the above-mentioned embodiments are only illustrations for working the present invention. Therefore, the present invention is not limited to the above-mentioned embodiments. The above-mentioned embodiments can be suitably changed within a scope not departing from the gist of the invention.

REFERENCE SIGNS LIST

1. porous layer
2. compound layer
3. nitrogen diffused layer

The invention claimed is:

1. A nitrided steel part comprising a steel material as a material, the steel material consisting of, by mass %,
C: 0.05 to 0.25%,
Si: 0.05 to 1.5%,
Mn: 0.2 to 2.5%,
P: 0.025% or less,
S: 0.003 to 0.05%,
Cr: over 0.5 to 2.0%,
Al: 0.01 to 0.05%,
N: 0.003 to 0.025%,
optionally one or more of
Mo: 0.01 to less than 0.50%,
V: 0.01 to less than 0.50%,
Cu: 0.01 to less than 0.50%,
Ni: 0.01 to less than 0.50%, and
Ti: 0.005 to less than 0.05%, and
a balance of Fe and impurities,
the nitrided steel part comprising a compound layer of a thickness of 3 μm or less containing iron, nitrogen, and carbon formed on the steel surface and a hardened layer formed under the compound layer,
an effective hardened layer depth of the nitrided steel part being 160 to 410 μm,
wherein the effective hardened layer depth (μm) is defined as the depth in a range where the Vickers hardness in the distribution measured in the depth direction from the surface of the test material using the hardness distribution in the depth direction obtained by the above Vickers hardness test is 300 HV or more.

2. The nitrided part of claim 1 wherein a ratio of voids in an area of 25 $\mu m^2$ in a range of 5 μm depth from an outermost surface of said steel material is less than 10%.

3. A method of production of a nitrided steel part comprising a steel material as a material, the steel material consisting of, by mass %,
C: 0.05 to 0.25%,
Si: 0.05 to 1.5%,
Mn: 0.2 to 2.5%,
P: 0.025% or less,
S: 0.003 to 0.05%,
Cr: over 0.5 to 2.0%,
Al: 0.01 to 0.05%,
N: 0.003 to 0.025%,
optionally one or more of
Mo: 0.01 to less than 0.50%,
V: 0.01 to less than 0.50%,
Cu: 0.01 to less than 0.50%,
Ni: 0.01 to less than 0.50%, and
Ti: 0.005 to less than 0.05%, and
a balance of Fe and impurities,
the method comprising providing a step of gas nitriding by heating the steel material in a gas atmosphere containing $NH_3$, $H_2$, and $N_2$ to 550 to 620° C., and making the overall treatment time A 1.5 to 10 hours,
the gas nitriding comprising high $K_N$ value treatment having a treatment time of X hours and a low $K_N$ value treatment after the high $K_N$ value treatment having a treatment time of Y hours,
the high $K_N$ value treatment having a nitriding potential $K_{NX}$ determined by formula (1) of 0.15 to 1.50 and having an average value $K_{NXave}$ of the nitriding potential $K_{NX}$ determined by formula (2) of 0.30 to 0.80, the low $K_N$ value treatment having a nitriding potential $K_{NY}$ determined by formula (3) of 0.02 to 0.25, having an average value $K_{NYave}$ of the nitriding potential $K_{NY}$ determined by formula (4) of 0.03 to 0.20, and having an average value $K_{Nave}$ of the nitriding potential determined by formula (5) of 0.07 to 0.30:

$$K_{NX}=(\mathrm{NH_3}\text{ partial pressure})_X/[(\mathrm{H_2}\text{ partial pressure})^{3/2}]_X \quad (1)$$

$$K_{NXave}=\Sigma_{i=1}^{n}(X_0\times K_{NXi})/X \quad (2)$$

$$K_{NY}=(\mathrm{NH_3}\text{ partial pressure})_Y/[(\mathrm{H_2}\text{ partial pressure})^{3/2}]_Y \quad (3)$$

$$K_{NYave}=\Sigma_{i=1}^{n}(Y_0\times K_{NYi})/Y \quad (4)$$

$$K_{Nave}=(X\times K_{NXave}+Y\times K_{NYave})/A \quad (5)$$

wherein, in formula (2) and formula (4), the subscript "i" is a number indicating the number of measurements for each constant time interval, $X_0$ indicates the measurement interval (hours) of the nitriding potential $K_{NX}$, $Y_0$ indicates the measurement interval (hours) of the nitriding potential $K_{NY}$, $K_{NXi}$ indicates the nitriding potential at the i-th measurement during the high $K_N$ value treatment, and $K_{NYi}$ indicates the nitriding potential at the i-th measurement during the low $K_N$ value treatment.

4. The method of production of the nitrided steel part of claim 3 wherein the gas atmosphere includes a total of 99.5 vol % of $NH_3$, $H_2$, and $N_2$.

* * * * *